US010149072B2

(12) United States Patent
Long et al.

(10) Patent No.: US 10,149,072 B2
(45) Date of Patent: Dec. 4, 2018

(54) BINAURAL CUE PRESERVATION IN A BILATERAL SYSTEM

(71) Applicant: Cochlear Limited, Macquarie University (AU)

(72) Inventors: Christopher Joseph Long, Centennial, CO (US); Lakshmish Ramanna, Parker, CO (US)

(73) Assignee: Cochlear Limited, Macquarie University (AU)

( * ) Notice: Subject to any disclaimer, the term of this patent is extended or adjusted under 35 U.S.C. 154(b) by 96 days.

(21) Appl. No.: 15/278,487

(22) Filed: Sep. 28, 2016

(65) Prior Publication Data

US 2018/0091907 A1 Mar. 29, 2018

(51) Int. Cl.
*H04R 25/00* (2006.01)
*H04S 1/00* (2006.01)

(52) U.S. Cl.
CPC ..... *H04R 25/552* (2013.01); *H04R 25/505* (2013.01); *H04S 1/007* (2013.01); *H04S 2420/01* (2013.01)

(58) Field of Classification Search
None
See application file for complete search history.

(56) References Cited

U.S. PATENT DOCUMENTS 5,706,352 A * 1/1998 Engebretson ..... H04R 25/70 381/312
6,115,478 A * 9/2000 Schneider ..... H04R 25/70 381/312
6,151,400 A * 11/2000 Seligman ..... H03G 3/3005 381/101
6,272,229 B1 * 8/2001 Baekgaard ..... H04R 25/407 381/312
6,496,734 B1 * 12/2002 Money ..... A61N 1/36036 607/56
7,630,507 B2 12/2009 Kates
8,953,810 B2 2/2015 Meskens et al.
9,042,996 B2 5/2015 Van Baelen et al.
9,185,505 B2 * 11/2015 Kristensen ..... H04R 25/453
9,241,222 B2 1/2016 Ma
9,288,587 B2 3/2016 Ma
2003/0112987 A1 * 6/2003 Nordqvist ..... H04R 25/505 381/312

(Continued)

FOREIGN PATENT DOCUMENTS

JP 2003-511880 A 3/2003

OTHER PUBLICATIONS

Inntemational Search Report and Written Opinion in corresponding International Application No. PCT/IB2017/055802, dated Jan. 11, 2018, 8 pages.

*Primary Examiner* — Peter Vincent Agustin
(74) *Attorney, Agent, or Firm* — Edell, Shapiro & Finnan, LLC

(57) ABSTRACT

Presented herein are techniques for preservation/retention of binaural cues in a bilateral system, such as a bilateral hearing/auditory prosthesis system. The bilateral system comprises first and second bilateral prostheses, each of which includes an automatic gain control (AGC) system. The first and second bilateral prostheses communicate with one another over a AGC update channel/link to exchange AGC updates in a power-efficient manner.

27 Claims, 19 Drawing Sheets

(56) References Cited

U.S. PATENT DOCUMENTS

| | | | | |
|---|---|---|---|---|
| 2004/0066944 | A1* | 4/2004 | Leenen | H04R 25/305 381/314 |
| 2006/0239468 | A1* | 10/2006 | Desloge | H04R 25/30 381/60 |
| 2010/0063828 | A1* | 3/2010 | Ishikawa | G10L 19/008 704/501 |
| 2010/0184383 | A1* | 7/2010 | Lerke | H04R 25/552 455/66.1 |
| 2011/0069846 | A1 | 3/2011 | Cheng et al. | |
| 2013/0010972 | A1* | 1/2013 | Ma | H04R 25/356 381/23.1 |
| 2013/0085549 | A1* | 4/2013 | Case | H04R 25/305 607/55 |
| 2013/0103396 | A1* | 4/2013 | Swanson | H03G 7/002 704/225 |
| 2013/0195278 | A1* | 8/2013 | Swanson | H03G 1/00 381/57 |
| 2013/0259277 | A1* | 10/2013 | Kojima | H04R 25/453 381/317 |
| 2013/0308804 | A1* | 11/2013 | Meskens | H04R 25/552 381/315 |
| 2014/0074463 | A1 | 3/2014 | Litvak et al. | |
| 2014/0214123 | A1 | 7/2014 | Janssen et al. | |
| 2015/0222997 | A1 | 8/2015 | Fang | |
| 2016/0088406 | A1* | 3/2016 | Wernaers | H04S 7/303 381/317 |
| 2016/0353215 | A1* | 12/2016 | Kindred | H04R 25/505 |

* cited by examiner

BINAURAL CUE PRESERVATION IN A BILATERAL SYSTEM

BACKGROUND

Field of the Invention

The present invention relates generally to wireless communication in bilateral hearing prosthesis systems.

Related Art

Medical device systems have provided a wide range of therapeutic benefits to recipients over recent decades. For example, a hearing prosthesis system is a type of medical device system that includes one or more hearing prostheses that operate to convert sound signals into one or more acoustic, mechanical, and/or electrical stimulation signals for delivery to a recipient. The one or more hearing prostheses that can form part of a hearing prosthesis system include, for example, hearing aids, cochlear implants, middle ear stimulators, bone conduction devices, brain stem implants, electro-acoustic devices, and other devices providing acoustic, mechanical, and/or electrical stimulation to a recipient.

One specific type of hearing prosthesis system, referred to herein as a "bilateral hearing prosthesis system" or more simply as a "bilateral system," includes two hearing prostheses, positioned at each ear of the recipient. More specifically, in a bilateral system each of the two prostheses provides stimulation to one of the two ears of the recipient (i.e., either the right or the left ear of the recipient). Bilateral systems can improve the recipient's perception of sound signals by, for example, eliminating the head shadow effect, leveraging interaural time delays and level differences that provide cues as to the location of the sound source and assist in separating desired sounds from background noise, etc.

SUMMARY

In one aspect presented herein, a bilateral hearing prosthesis system is provided. The bilateral hearing prosthesis system comprises: a first hearing prosthesis including: at least a first sound input element configured to receive sound signals, and a first automatic gain control (AGC) system configured to attenuate levels of the sound signals received at the at least first sound input element. The bilateral hearing prosthesis system also comprises a second hearing prosthesis including: at least a second sound input element configured to receive sound signals; a second AGC system configured to attenuate levels of the sound signals received at the at least second sound input element, wherein the first and second hearing prostheses are configured to exchange AGC updates with one another at an AGC update rate selected based on the operational timing of one or more of the first or second AGC systems.

In another aspect presented herein, a method is provided. The method comprises: receiving sound signals at first and second bilateral hearing prostheses, wherein the first and second hearing prostheses are each configured to execute one or more automatic gain control (AGC) operations on the sound signals; and sending AGC updates from at least the first hearing prosthesis to the second hearing prosthesis, wherein a sending rate of the AGC updates is set based on an operational timing parameter associated with at least one of the one or more AGC operations.

In another aspect presented herein, a hearing prosthesis is provided. The hearing prosthesis comprises: an automatic gain control (AGC) system configured to manipulate levels of sound signals received at the hearing prosthesis; and a transceiver configured to operate a wireless AGC channel over which AGC updates can be sent to a second hearing prosthesis, and wherein the rate at which AGC updates are sent by the transceiver is dynamically adjustable.

BRIEF DESCRIPTION OF THE DRAWINGS

Embodiments of the present invention are described herein in conjunction with the accompanying drawings, in which.

DETAILED DESCRIPTION

Presented herein are techniques for preservation/retention of binaural cues in a bilateral system, such as a bilateral hearing/auditory prosthesis system. The bilateral system comprises first and second bilateral prostheses, each of which includes an automatic gain control (AGC) system. The first and second bilateral prostheses communicate with one another over a wired or wireless AGC update channel/link to exchange AGC updates in a power-efficient manner. In certain embodiments, the rate at which the AGC updates are sent (i.e., the timing of the AGC updates), referred to herein as the AGC update rate, may be based on the operational timing parameter associated with at least one AGC operation of one or more of the AGC systems in the first and second bilateral prostheses.

For ease of illustration, embodiments of the present invention will be described with reference to a particular illustrative bilateral hearing prosthesis system, namely a bilateral cochlear implant system. However, it would be appreciated that embodiments of the present invention may be used in other bilateral hearing prosthesis systems, such as bimodal systems, bilateral hearing prosthesis systems including auditory brainstem stimulators, hearing aids, bone conduction devices, mechanical stimulators, etc. Accordingly, it would be appreciated that the specific implementations described below are merely illustrative and do not limit the scope of the present invention.

Figure 1A:
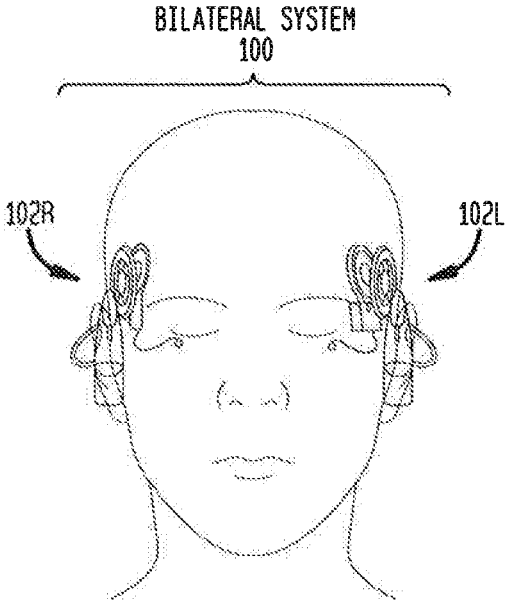
FIG. 1A is a schematic view of a bilateral hearing prosthesis system in which embodiments of presented herein may be implemented.
Figure 1B:
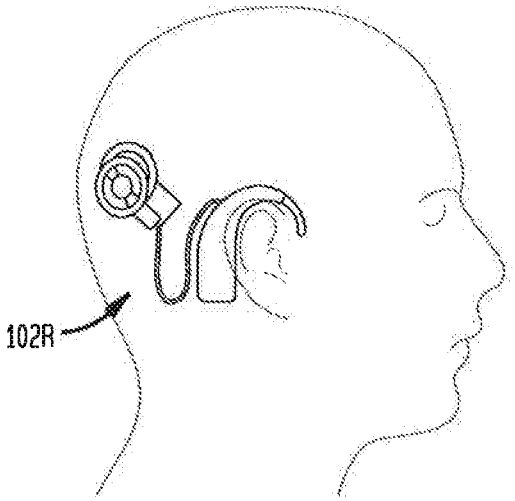
FIG. 1B is a side view of a recipient including the bilateral hearing prosthesis system of FIG. 1A.
Figure 2:
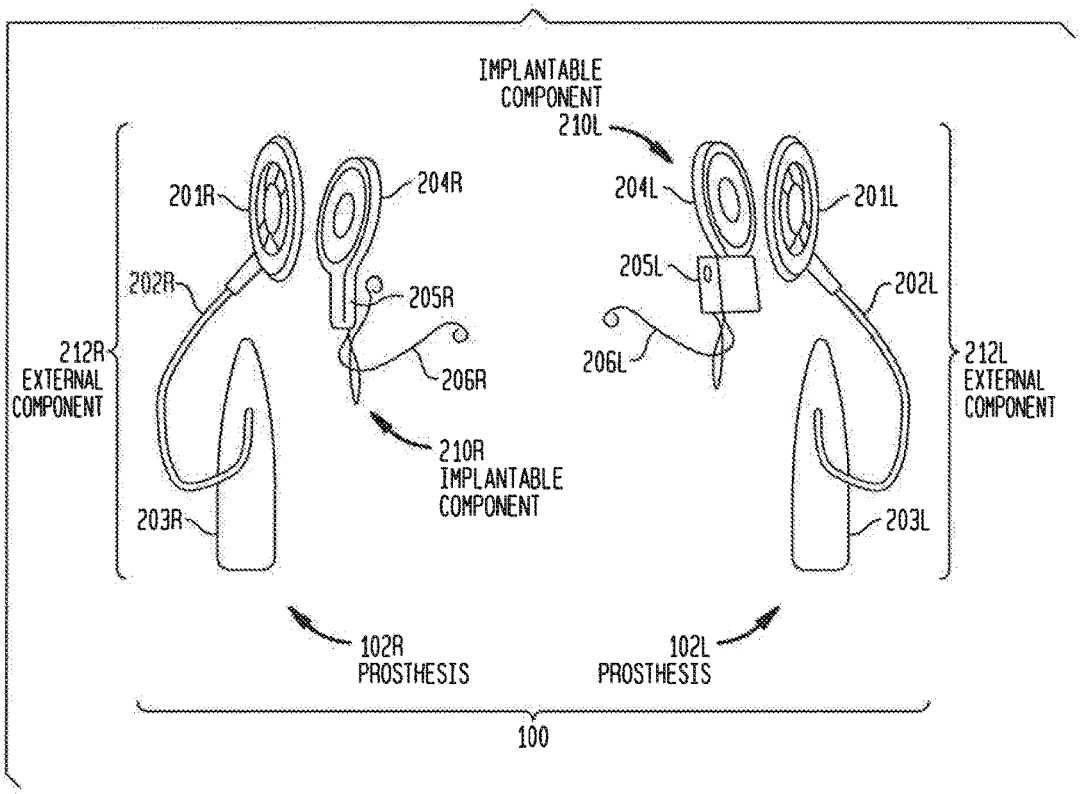
FIG. 2 is a schematic view of the components of the bilateral hearing prosthesis system of FIG. 1A.

FIGS. 1A and 1B are schematic drawings of a recipient wearing a left cochlear prosthesis 102L and a right cochlear prosthesis 102R, collectively referred to as "bilateral prostheses" that form a bilateral cochlear implant system (bilateral system) 100. FIG. 2 is a schematic view of bilateral system 100 of FIGS. 1A and 1B. As shown in FIG. 2, prosthesis 102L includes an external component 212L comprising a sound processing unit 203L electrically connected to an external coil 201L via cable 202L.

Prosthesis 102L also includes implantable component 210L implanted in the recipient. Implantable component 210L includes an internal coil 204L, a stimulator unit 205L and a stimulating assembly (e.g., electrode array) 206L implanted in the recipient's left cochlea (not shown in FIG. 2). In operation, a sound received by prosthesis 102L is converted to an encoded data signal by a sound processor within sound processing unit 203L, and is transmitted from external coil 201L to internal coil 204L via, for example, a magnetic inductive radio frequency (RF) link. This link, referred to herein as a Closely Coupled Link (CCL), is also used to transmit power from external component 212L to implantable component 210L.

In the example of FIG. 2, prosthesis 102R is substantially similar to prosthesis 102L. In particular, prosthesis 102R includes an external component 212R comprising a sound processing unit 203R, a cable 202R, and an external coil 201R. Prosthesis 102R also includes an implantable component 210R comprising internal coil 204R, stimulator 205R, and stimulating assembly 206R.

Figure 3:
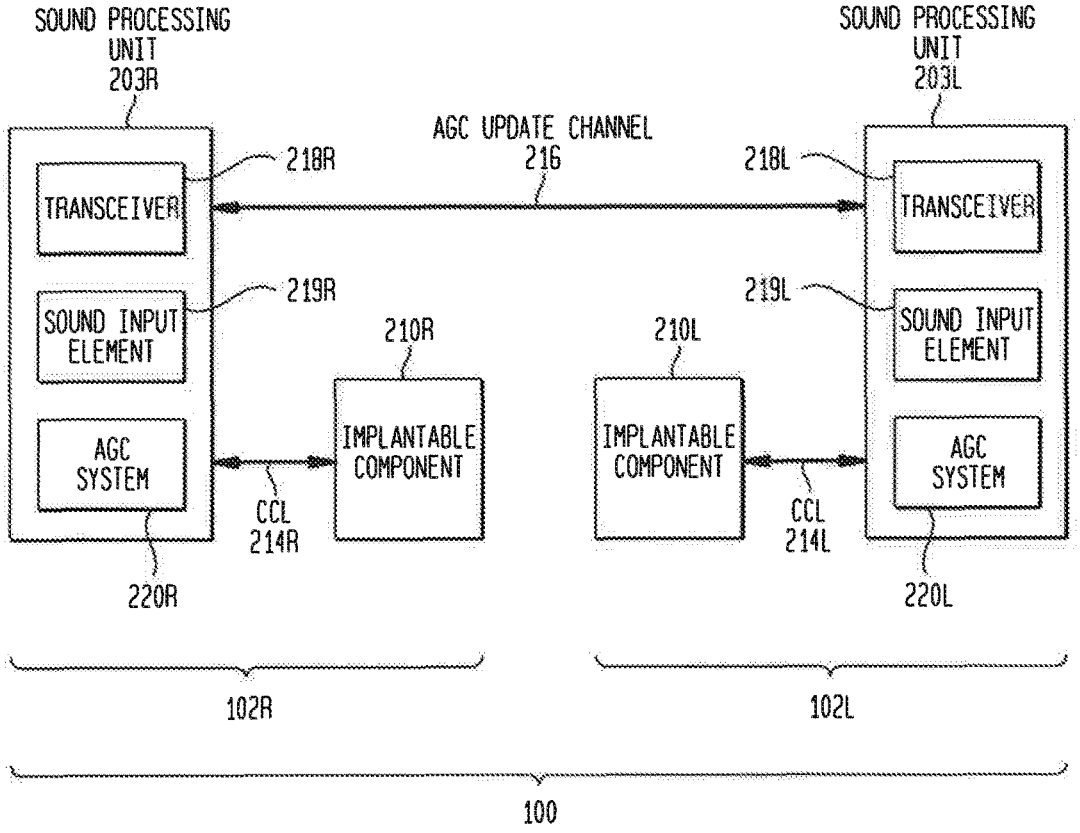
FIG. 3 is a functional block diagram of selected components of the bilateral hearing prosthesis system of FIG. 1A.

FIG. 3 is a schematic diagram that functionally illustrates selected components of bilateral system 100, as well as the communication links implemented therein. As noted, bilateral system 100 comprises sound processing units 203L and 203R. The sound processing unit 203L comprises a transceiver 218L, at least one sound input element (e.g., microphone) 219L, and an automatic gain control (AGC) system 220L forming part of a sound processor. Similarly, sound processing unit 203R also comprises a transceiver 218R, at least one sound input element (e.g., microphone) 219R, and an AGC system 220R forming part of a sound processor.

Sound processor 203L communicates with an implantable component 210L via a CCL 214L, while sound processor 203R communicates with implantable component 210R via CCL 214R. In one embodiment, CCLs 214L and 214R are magnetic induction (MI) links, but, in alternative embodiments, links 214L and 214R may be any type of wireless link now know or later developed. In the exemplary arrangement of FIG. 3, CCLs 214L and 214R generally operate (e.g., purposefully transmit data) at a frequency in the range of about 5 to 50 MHz.

As shown in FIG. 3, sound processing units 203L and 203R use the transceiver 218L and 218R to communicate with one another via a separate wireless AGC update channel or link 216. The AGC update channel 216 may be, for example, a magnetic inductive (MI) link, a short-range wireless link, such as a Bluetooth® link that communicates using short-wavelength Ultra High Frequency (UHF) radio waves in the industrial, scientific and medical (ISM) band from 2.4 to 2.485 gigahertz (GHz), or another type of wireless link. Bluetooth® is a registered trademark owned by the Bluetooth® SIG. As described further below, in accordance with embodiments presented herein, the AGC update channel 216 is used to transmit bilateral AGC updates at a power-efficient rate that is selected based on the operational timing parameter associated with at least one AGC operation of one or more of the AGC systems 220L and 220R. Although FIGS. 1A, 1B, 2, and 3 generally illustrate the use of wireless communications between the bilateral prostheses 102L and 102R, it is to be appreciated that the embodiments presented herein may also be implemented in systems that use a wired bilateral link.

FIGS. 1A, 1B, 2, and 3 generally illustrate an arrangement in which the bilateral system 100 includes external components located at the left and right ears of a recipient. It is to be appreciated that embodiments of the present invention may be implemented in bilateral systems having alternative arrangements. For example, embodiments of the present invention can also be implemented in a totally implantable bilateral system. In a totally implantable bilateral system, all components are configured to be implanted under skin/tissue of a recipient and, as such, the system operates for at least a finite period of time without the need of any external devices.

Figure 4:
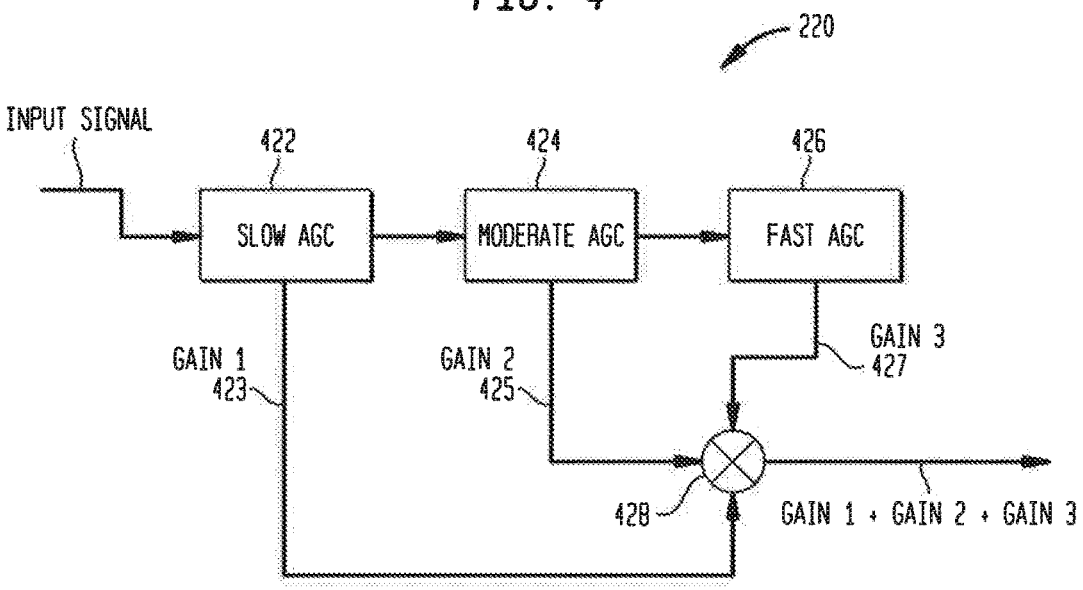
FIG. 4 is a block diagram of an automatic gain control (AGC) system in a bilateral hearing prosthesis system, in accordance with embodiments presented herein.

As noted above, the cochlear prostheses 102L and 102R include a sound processing unit 203L and 203R, respectively, that each includes a sound processor. The sound processors in the sound processing unit 203L and 203R are each configured to perform one or more sound processing operations to convert sound signals into stimulation control signals that are useable by a stimulator unit to generate electrical stimulation signals for delivery to the recipient. These sound processing operations generally include Automatic Gain Control (AGC) operations and, as such, the sound processors are generally referred to as each comprising an AGC system. In other words, the AGC systems 220L and 220R of FIG. 2 may functionally operate as part of a sound processor. FIG. 4 is a block diagram illustrating one example arrangement for an AGC system 220 of a sound processor in a bilateral prosthesis, such as bilateral prostheses 102R and 102L in FIGS. 1A-3. For ease of illustration, the embodiments presented herein will be described with reference to bilateral prostheses 102R and 102L each comprising the AGC system 220 of FIG. 4.

FIG. 4 illustrates an example tri-loop or tri-stage AGC system 220 comprised of three AGC stages/modules/blocks, referred to herein as AGCs 422, 424, and 426. AGC 422 is sometimes referred to herein as a "Slow AGC," AGC 424 is sometimes referred to herein as a "Moderate AGC," and AGC 426 is sometimes referred to herein as a "Fast AGC." In general, the AGCs 422, 424, and 426 each operate to manipulate (i.e., attenuate) the sound signals in order to avoid signal clipping, distortion, and other degradations and to present the wide dynamic range of sounds in the smaller dynamic range found in electric and impaired acoustic hearing. For example, the AGCs 422, 424, and 426 each generate a gain 423, 425, and 427, respectively, that are combined, if appropriate, at a combination block 428 for application to the sound signals. As described further zero, one, two, or three of the AGCs 422, 424, and 426 may be activated and generating gains at any one time.

Each of the AGCs 422, 424, and 426 operate at different time scales and are triggered at different sound signal (input) levels, referred to as "kneepoints." The Slow AGC 422 has the lowest kneepoint and operates at the slowest time scale, while AGCs 424 and 426 operate at increasingly faster time scales. AGCs 424 and 426 also have higher kneepoints than the Slow AGC. In one example, the Slow AGC 422 has a kneepoint of X decibels of sound pressure level (dB SPL), and a slow time constant of XA milliseconds (ms). In other words, if the detected sound signals have an amplitude (level) which crosses above X dB SPL, then the Slow AGC 422 is activated to implement a reduction in the gain (i.e., generate a negative gain 423). This reduction occurs slowly over a time period of XA ms (i.e., the time constant indicates the time period of which the Slow AGC 422 implements the gain reduction).

The AGCs 424 and 426 operate similarly to the slow AGC 422. For example, AGC 426 may have a Y dB SPL kneepoint, and a time constant of YA ms (i.e., if the level of the sound signals increases above Y dB SPL, then this Fast AGC will rapidly reduce the gain so that the effective signal level is below Y dB SPL). AGC 424 can have another kneepoint, such as Z dB SPL, but a more moderate time constant of between XA ms and YA ms.

It is to be appreciated that the tri-loop AGC system of FIG. 4 is merely illustrative and that embodiments presented herein may be implemented with prostheses that include different types of AGC systems. For example, the embodiments presented herein may be implemented with dual-loop or single-loop AGC systems with a variety of possible kneepoints and time constants.

Figure 5:
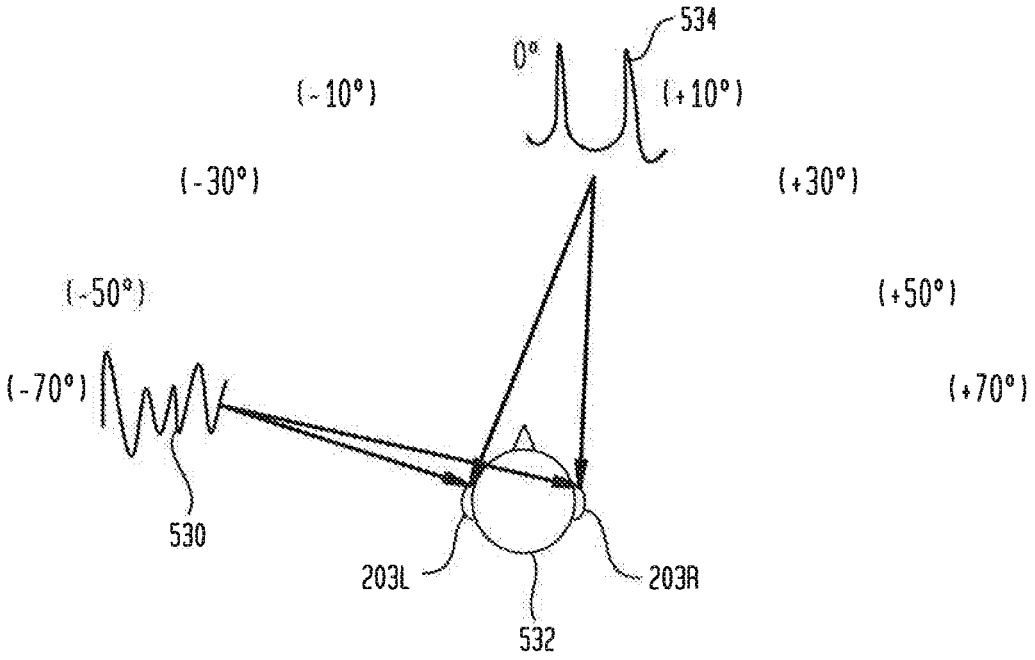
FIG. 5 is a diagram illustrating an example presentation of sound signals to a recipient of a bilateral hearing prosthesis system, in accordance with embodiments presented herein.

Individuals with normal hearing rely heavily on binaural cues, such as Interaural Time Differences (ITDs) and Interaural Level Differences (ILDs), for speech understanding in noise and sound localization. However, in bilateral systems (including bimodal systems), the ILD cues can easily be distorted by the AGC systems in the two hearing prostheses, which, in turn, limits the recipient's sound localization and speech understanding abilities. For example, FIG. 5 is a diagram illustrating an example presentation of sound signals 530 from the left of a recipient 532 of bilateral system 100, followed by presentation of sound signals 534 from the right of the recipient 532. In this example, sound signal 530 is a 70 dB SPL white noise signal presented at −70 degrees from the front of the recipient, while sound signal 534 is a 70 dB SPL modulated noise signal presented at +10 degrees from the front of the recipient.

Figure 6A:
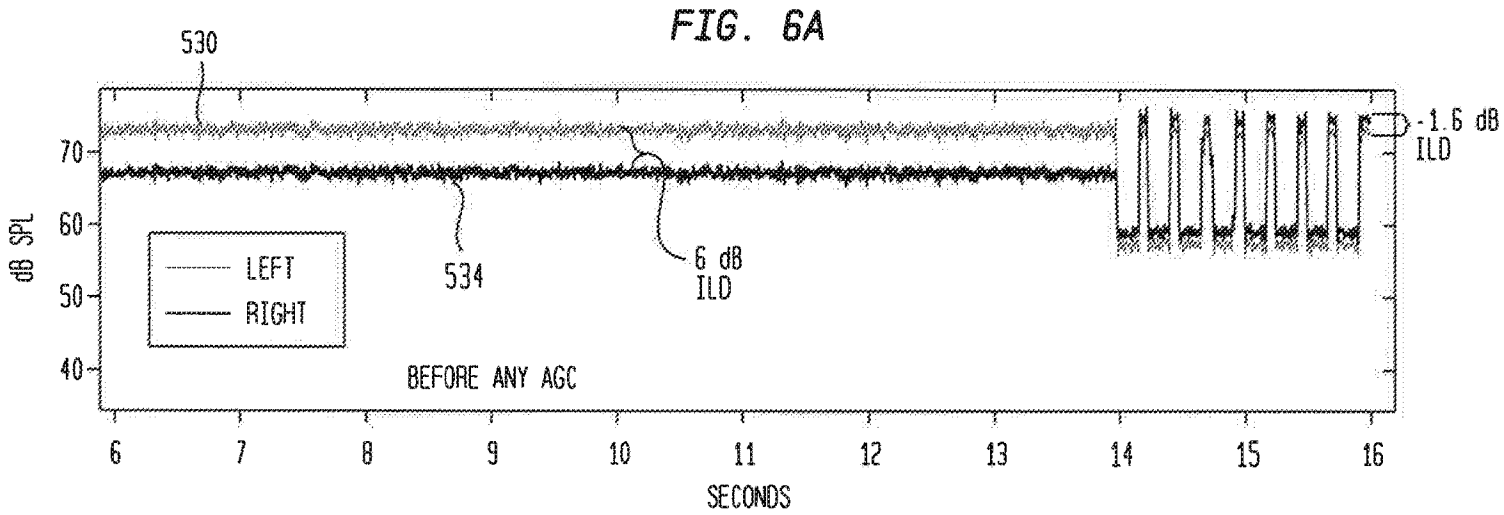
FIGS. 6A, 6B, and 6C are a series of graphs illustrating distortion caused by AGC systems in bilateral hearing prostheses of a hearing prosthesis bilateral system when the two bilateral hearing prostheses do not communicate with one another.
Figure 6B:
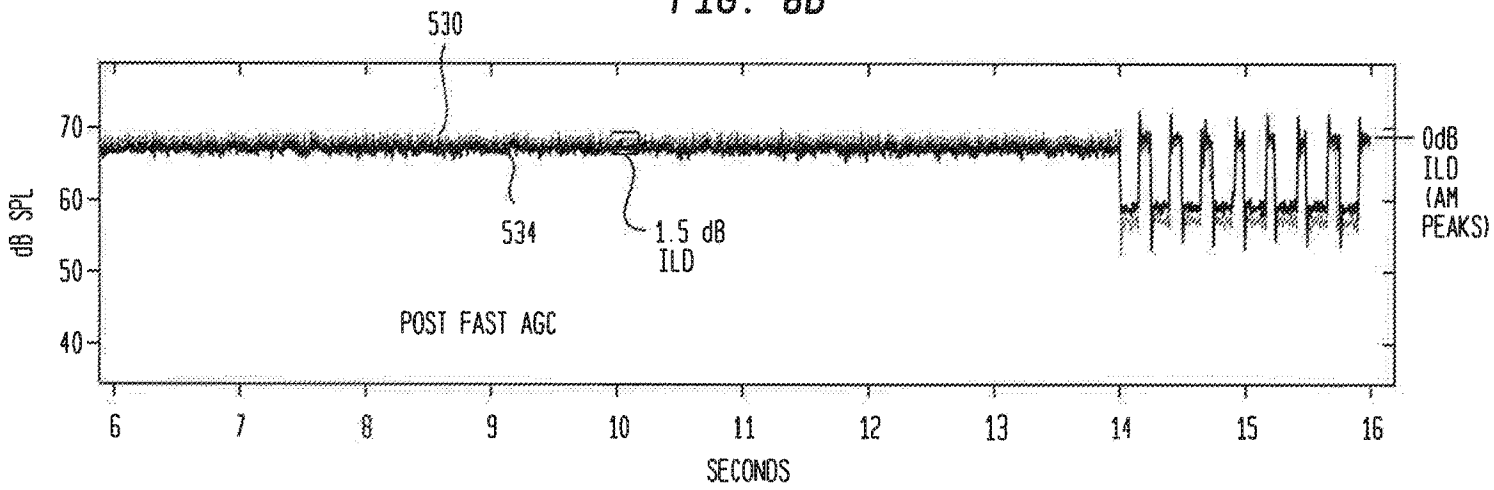
Figure 6C:
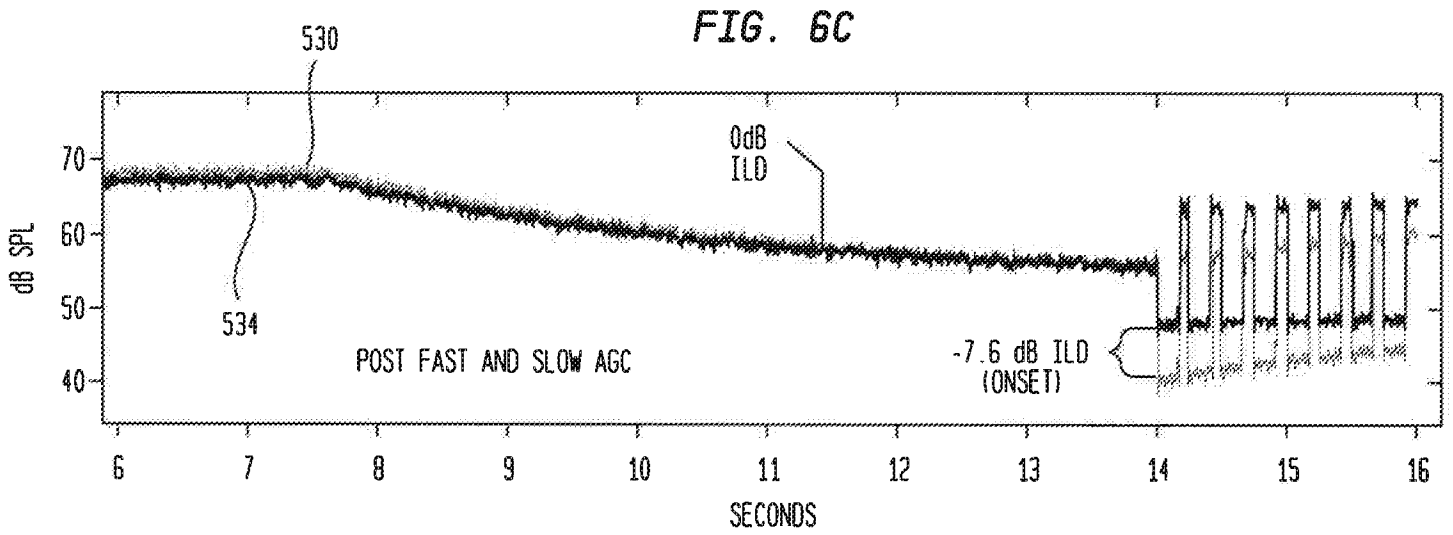

In a typical bilateral system, each of the two prostheses operates at least partially independently from the other prosthesis. FIGS. 6A, 6B, and 6C are a series of graphs illustrating distortion caused by the independent operation of Slow AGCs in two bilateral hearing prostheses (forming a bilateral system) that receive the sound signals shown in FIG. 5. That is, FIGS. 6A-6C illustrate an example in which the two bilateral hearing prostheses do not exchange AGC updates with one another. FIGS. 6A-6C all have the same vertical axis representing sound signal levels in dB SPL at the left and right ears of the recipient (either before or after processing by an AGC), as well as the same horizontal axis representing time in seconds.

Referring first to FIG. 6A, the ILD, shown as the difference between the two traces, is the difference in the levels between the input sound signals 530 (i.e., received from the left) and the input sound signals 534 (i.e., received from the right)) before application of any automatic gain control to the sound signals. As shown in FIG. 6A, the sound signals 530 and 534 have a 6 dB ILD for a first time period (e.g., until approximately 14 seconds) followed by a second period where the modulated signals have an ILD of −1.6 dB.

FIG. 6B illustrates the ILD between the input sound signals 530 and 534 following application of a Fast AGC, such as AGC 426 of FIG. 4, at the two prostheses. In particular, FIG. 6B illustrates that the Fast AGCs distort the ILD cue immediately and reduce it to 1.5 dB, and then to zero in the amplitude peaks for the second period of modulated signals.

FIG. 6C illustrates the ILD between the input sound signals 530 and 534 following application of a Fast AGC, such as AGC 426 of FIG. 4, as well as a Slow AGC, such as Slow AGC 422 of FIG. 4. As shown in FIG. 6C, the Slow AGC further reduces the ILD to 0 dB during the first period and then distorts the ILD during the second period of modulated signals to approximately −7.6 dB at the onset.

In summary, FIGS. 6A, 6B, and 6C illustrate that the AGCs can drastically distort the ILD cues, which are used by the brain to determine the direction from which sound signals originate. Therefore, the ILD distortion prevents the recipient from properly locating the direction of the sound signals (i.e., the recipient will think the sound is coming from an incorrect direction).

Figure 7A:
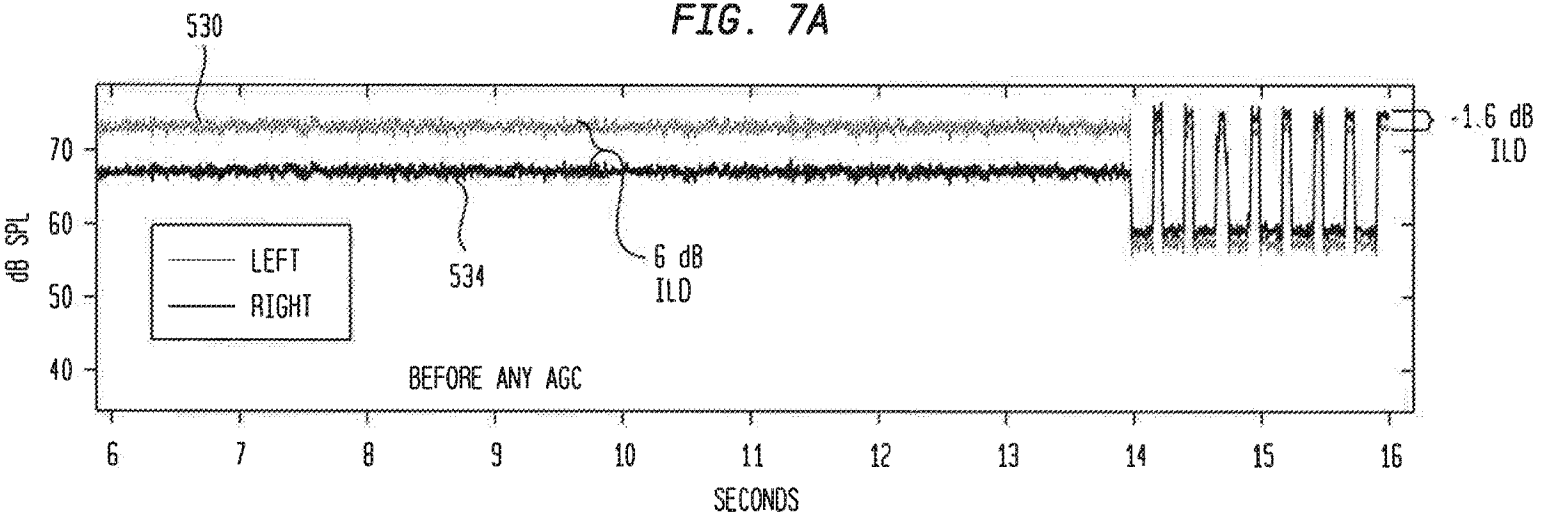
FIGS. 7A, 7B, and 7C are a series of graphs illustrating operation of two bilateral hearing prostheses have an ideal AGC update link.
Figure 7B:
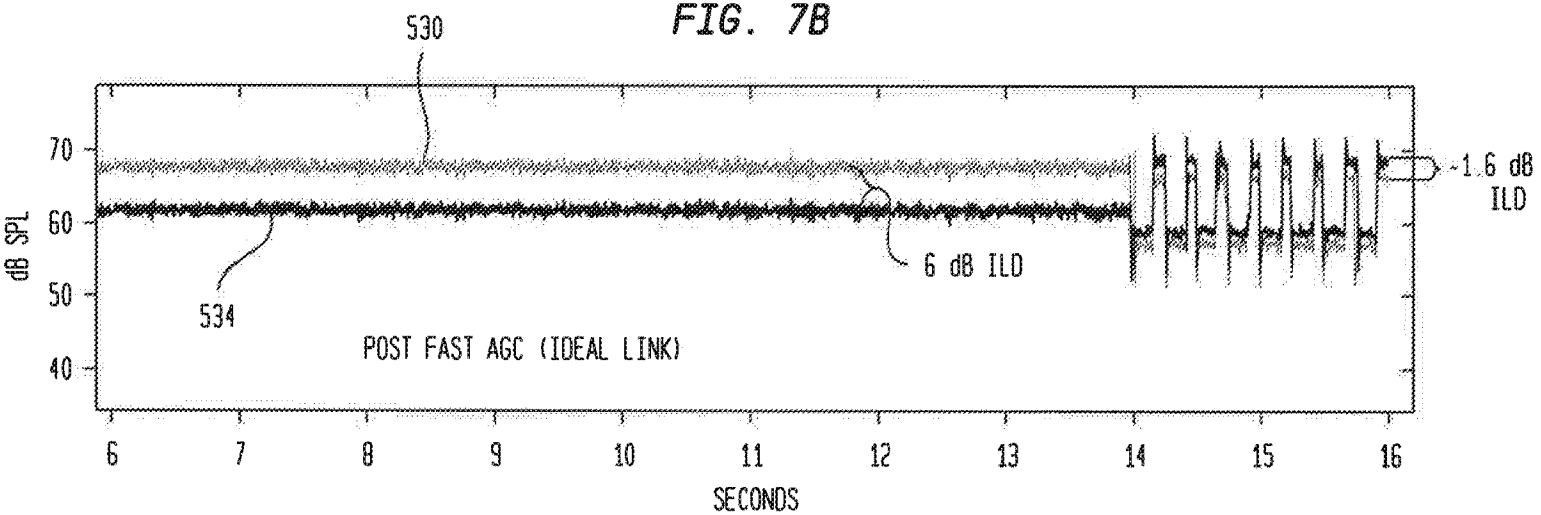
Figure 7C:
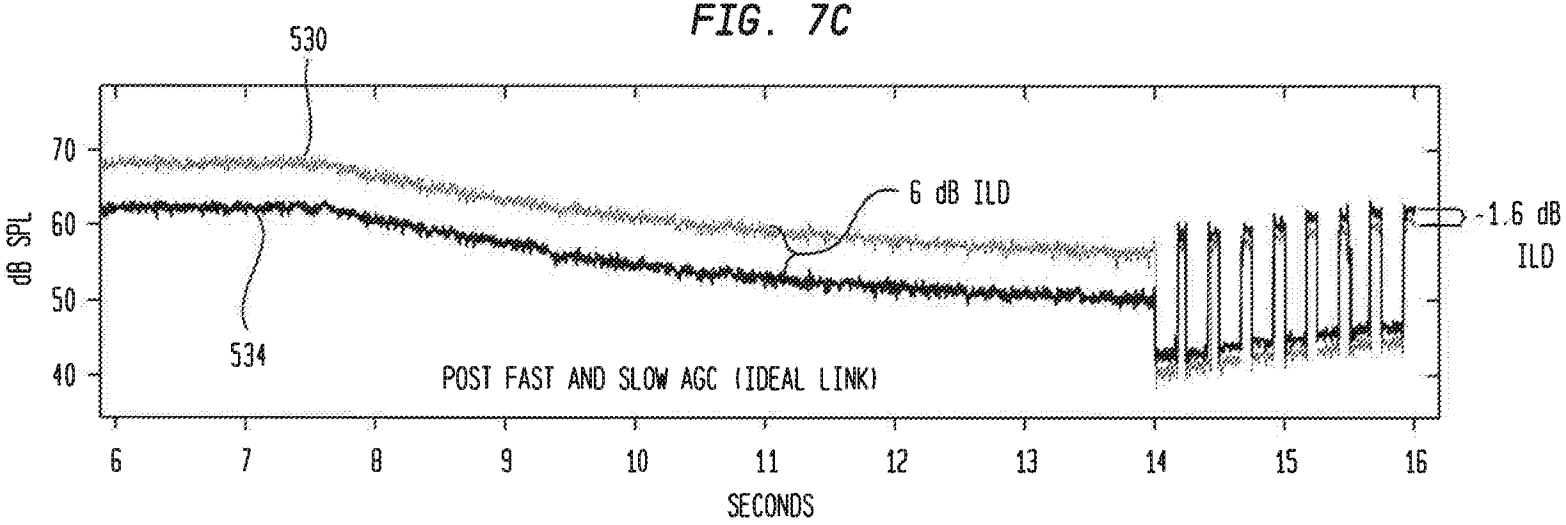

In contrast to FIGS. 6A-6C, FIGS. 7A-7C are a series of graphs illustrating a situation where two bilateral hearing prostheses have an ideal AGC link (i.e., the ability to instantaneously and constantly exchange AGC updates with one another). FIGS. 7A-7C all have the same horizontal and vertical axis as in FIGS. 6A-6C.

The example of FIGS. 7A-7C generally illustrate that an ideal AGC link between two bilateral AGC systems is able to preserve the ILD cues that are distorted in FIGS. 6A-6C. More specifically, FIGS. 7A-7C collectively illustrate that neither application of the Fast AGC (FIG. 7B) nor application of the Slow AGC (FIG. 7C) has any impact on the ILD cues when there is an ideal link between the two bilateral prostheses.

Although an ideal bilateral link can eliminate all ILD distortion, an ideal link is not feasible in practical applications and, such the, the ideal results of FIGS. 7A-7C are practically unachievable. For example, time delays are inherent in bilateral communications and these time delays detract from the ideal results shown in FIGS. 7A-7C. In addition, and more importantly, an ideal link requires constant communication between the two bilateral systems. Such constant communications would quickly drain the batteries of a bilateral hearing prosthesis system where the batteries must be either small enough to be worn on the recipient (i.e., in the external components) or small enough to be implanted within the recipient. These batteries are required to supply power for a number of different components of the prosthesis and it is impractical to use any significant portion of the stored power for bilateral communications.

Presented herein are techniques for preserving/retaining appropriate binaural cues (e.g., ILDs) between a pair of bilateral prostheses having separate AGC systems in a power-efficient manner, namely by minimizing the power utilized for the bilateral AGC communication (bilateral AGC updates). In particular, as described further below, in accordance with the embodiments presented herein, the transmission/sending rate for the bilateral AGC updates is based on the operational timing (i.e., timing parameter) of one or more of the bilateral AGC systems. Also as described further below, the AGC update rate may be dynamically adjusted based on one or more other parameters. The techniques presented herein can reduce the power drain of bilateral AGC communications while desirably providing substantial benefit for the recipient.

Figure 8A:
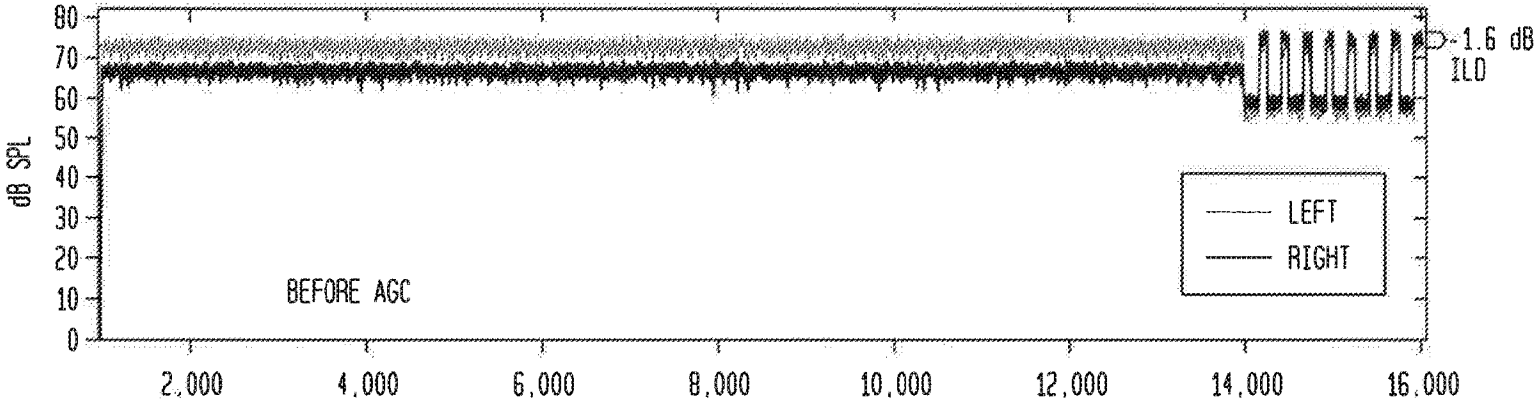
FIGS. 8A, 8B, and 8C are a series of graphs illustrating the result of one example implementation of the techniques presented herein to substantially preserve binaural cues in a bilateral hearing prosthesis system, in accordance with embodiments presented herein.
Figure 8B:
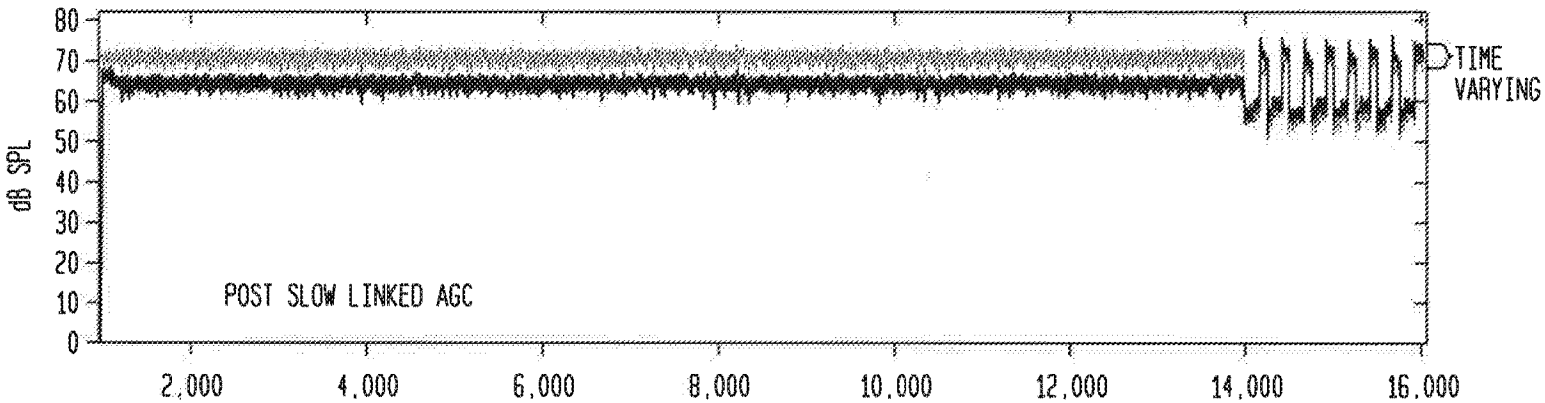
Figure 8C:
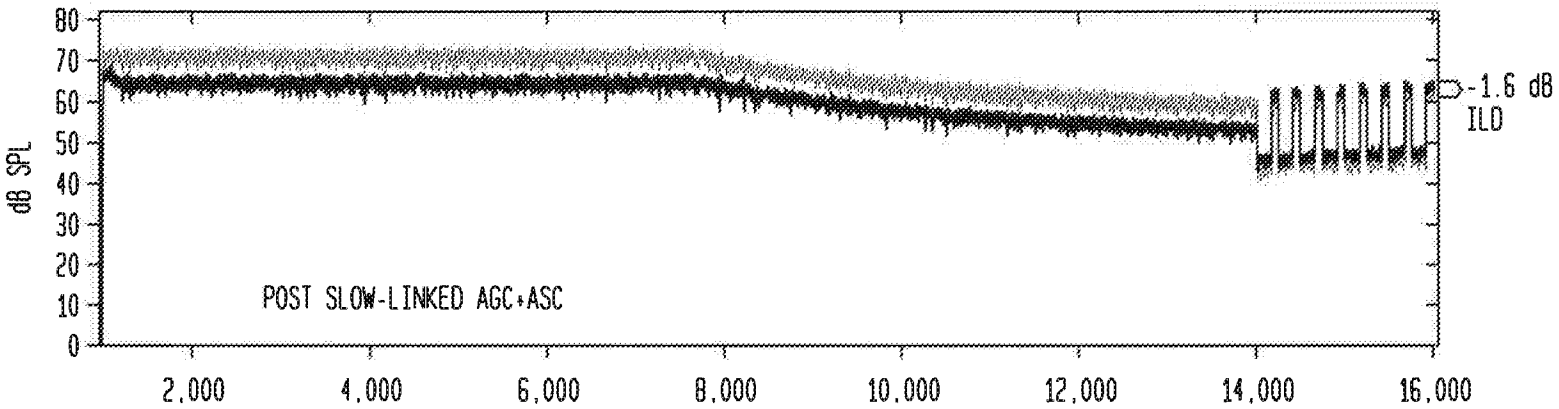

Further details of the power-efficient binaural cue retention techniques, sometimes referred to herein more simply as the binaural cue retention techniques, are provided below. However, before describing these details, FIGS. 8A-8B generally illustrate the result of one example implementation of the techniques presented herein to substantially preserve at least the ILD cues in a bilateral system. FIGS. 8A-8C all have the same vertical axis representing sound signal levels in dB SPL at the left and right ears of the recipient, as well as the same horizontal axis representing time in seconds.

FIG. 8A illustrates the ILD between the input sound signals 530 (i.e., received from the left) and the input sound signals 534 (i.e., received from the right)) before application of any automatic gain control to the sound signals. As shown in FIG. 8A, the sound signals 530 and 534 have 6 dB ILD for a first time period (e.g., until approximately 14 seconds) followed by a second period where modulated signals have an ILD of −1.6 dB.

FIG. 8B generally illustrates application of the Fast AGCs that are linked with one another in accordance with the embodiments presented herein, while FIG. 8C illustrates application of both the linked Fast AGCs and the linked Slow AGCs. As shown, in both cases the binaural cue retention techniques are able to preserve the ILD cues except for during the first 100 ms. In particular, referring specifically to FIG. 8C, since the Slow AGC reduces the levels to be below the higher AGC kneepoints, the other AGCs are not triggered by the later sound and, accordingly, the cues are preserved.

As noted, the binaural cue retention techniques presented may take any of a number of different arrangements where the timing of the bilateral AGC updates is based on the operational timing parameter of the bilateral AGCs. For example, the rate of the bilateral AGC updates may be a function of a time constant associated with one or both of the AGC systems of the bilateral prostheses. In one example, the bilateral AGC update rate is a function of the time constant associated with the slowest AGC block in one or more of the bilateral prostheses. Stated differently, the bilateral AGC updates are sent at a constant periodic rate determined from the slowest AGC time constant within the bilateral system. In other examples, the AGC updates are sent at a rate that is associated with a different time constant of one or both of the AGC systems.

For instance, for a bilateral system in which one or more of the AGCs have a slowest time constant of XA seconds, the update rate could be set to a value that is less than (e.g., a fraction of) XA seconds. In operation, the system will also account for transmission delays to keep the two bilateral prostheses synchronized.

In accordance with embodiments presented herein, the constant periodic AGC update rate determined from an AGC time constant associated with the bilateral AGC systems (e.g., the slowest AGC time constant within the bilateral system) may be dynamically adjusted based on, for example, further operational parameters of the bilateral AGC systems. For example, in one implementation, the AGC update rate may be dynamically changed based on when the Fast AGC would be triggered. This determination may be made based on the levels of the received sound signals.

More specifically, as noted above, in the embodiment of FIG. 4, the bilateral prostheses 102L and 102R each include the tri-loop or tri-stage AGC system 220 with AGC 422 (X dB SPL kneepoint), AGC 424 (Z dB SPL kneepoint), and AGC 426 (Y dB SPL kneepoint). In accordance with embodiments presented herein, when both of the prostheses 102L and 102R receive only sound signals having levels below the lowest AGC kneepoint (i.e., X dB SPL peak), none of the AGCs are activated and the AGC updates can be sent at a very low rate simply to maintain the link. However, when either of the prostheses 102L or 102R receives sound signals between the two lowest kneepoints (i.e., between X dB SPL peak and Y dB SPL peak), the Slow AGC 422 will be activated, but the fast AGC 426 will not be activated. As such, an update rate that is a fraction of the Slow AGC time constant (i.e., XA seconds) is sufficient. However, for sounds that approach the kneepoint for the Fast AGC 426 (i.e., Y dB SPL peak); the system 100 is configured to increase the AGC update rates. That is, when the system determines that there is a possibility of activating the Fast AGC 426 (i.e., a possibility of passing the second kneepoint); the system dynamically increases the AGC update rate. In these embodiments, the increased AGC update rate may be a function of levels tuned to the statistics of sound rather than an arbitrary function.

Figure 9:
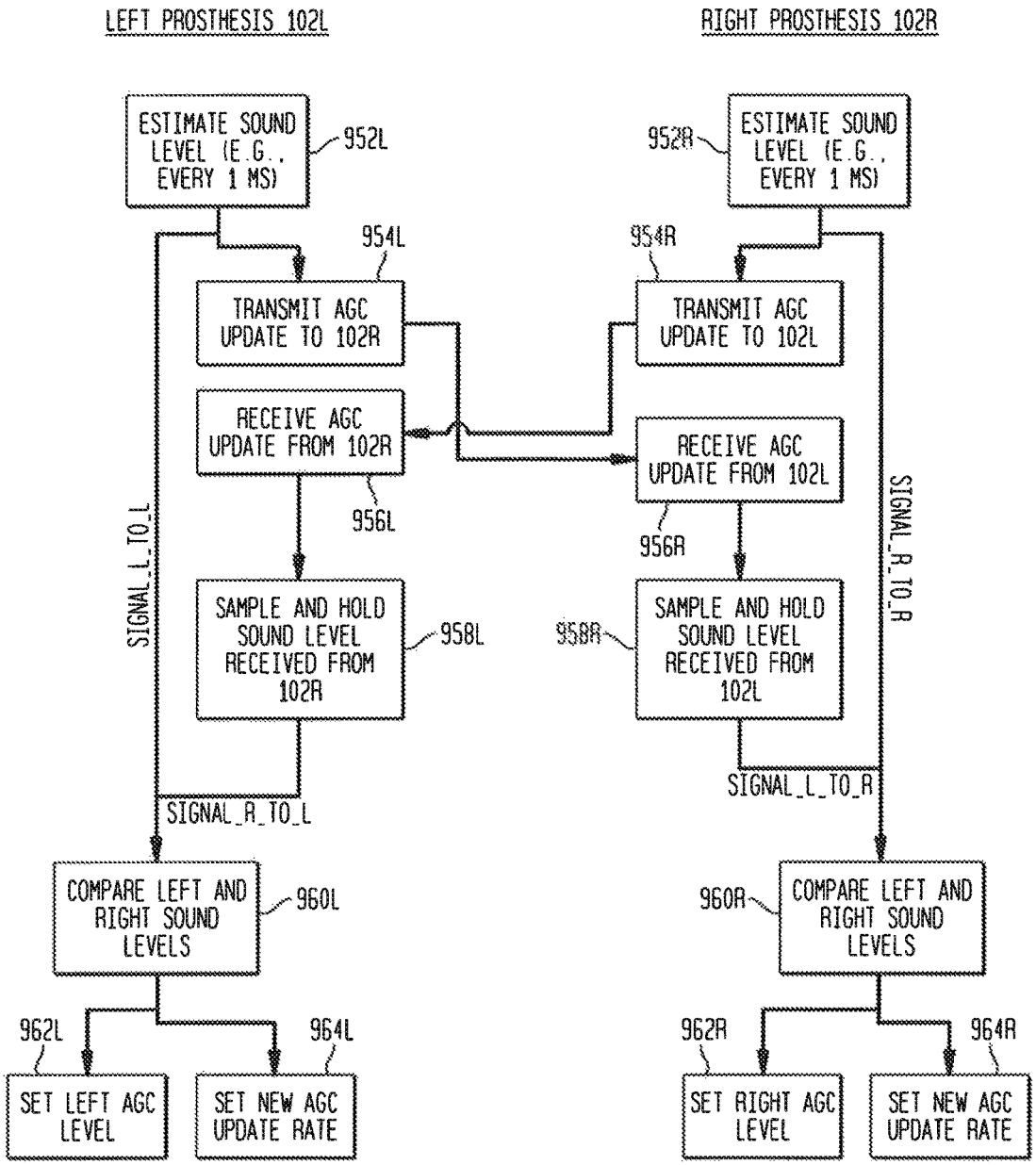
FIG. 9 is a flowchart of a method in which a bilateral hearing prosthesis system operates to dynamically adjust an AGC update rate, in accordance with embodiments presented herein.

FIG. 9 is a flowchart of a method 950 in which the bilateral system 100 operates to dynamically adjust the AGC update rate in accordance with embodiments presented herein. Method 950 illustrates two flows each representing the operations performed at one of the left prosthesis 102L and the right prosthesis 102R. These two flows each start at 952 where the left prosthesis 102L and the right prosthesis 102R each estimate the level of the sound signals detected at the respective prosthesis. This estimate may be performed by each of the prostheses 102L and 102R, for example, every 1 ms. For ease of description, the level of the sound signals detected at the left prosthesis 102L are referred to herein as the "left-side sound levels," while the level of the sound signals detected at right prosthesis 102R are referred to herein as the "right-side sound levels."

At 954, the left prosthesis 102L and the right prosthesis 102R each send an AGC update to the other contralateral prosthesis at a predetermined AGC update rate (e.g., at a rate that is fraction of the Slow AGC time constant) and, at 956, these updates are received at the contralateral prosthesis.

In certain embodiments, the AGC updates sent by the left prosthesis 102L and the right prosthesis 102R include/identify the level of the sounds detected at the sending prosthesis. As such, when the AGC updates are received from the contralateral prosthesis, each of the left prosthesis 102L and the right prosthesis 102R now has knowledge of the level of the sounds detected by the other prostheses. At 958, the sound level received from the contralateral prosthesis is stored for subsequent use.

At 960, the left prosthesis 102L and the right prosthesis 102R each analyze the left-side and right-side sound levels relative to one another. This comparative analysis of the sound levels may produce two results at each of the left prosthesis 102L and the right prosthesis 102R. In particular, as shown at 962, the analysis of the left-side and right-side sound levels relative to one another is used by each of the prostheses 102L and 102R to set the respective AGC levels (i.e., gain levels). Furthermore, as described further below, at 964, the analysis of the left-side and right-side sound levels relative to one another is used to set/select a new AGC update rate for the AGC updates sent between the prostheses 102L and 102R. Since the prostheses 102L and 102R use the same information for the comparative analysis of the left-side and right-side sound levels, both prostheses reach the same result on the new AGC update rate.

In certain embodiments, the selection of the new AGC update rate is a probabilistic determination based on when either the left-side or the right-side sound levels will cross the Fast AGC kneepoint. In one form, analysis of an hour long audio recording reveals the number of times sound levels increase above the fast AGC threshold. From this, the expected time period until crossing a Fast AGC threshold (e.g., Y dB SPL) for various levels can be predicted. An example result is shown below in Table 1, where the value "XY" is the current level of the detected sound signals. In general, the expected value is longest for the softest sounds. The minimum expected value for the left and right sides can be used to set the size of the next AGC update period (i.e., time until sending of the next AGC update). In certain embodiments, the new AGC update rate is set to the minimum expected value. In other embodiments, the new AGC update rate is set to a fraction of the minimum expected value or another function of the two expected values. The present sound level may be a maximum of the left-side and the right-side sound levels, an average of the left-side and the right-side sound levels, etc.

TABLE 1

| Present Sound Level | Minimum Expected Value (i.e., expected minimum time to cross Fast AGC kneepoint) |
|---|---|
| Less than 58 db SPL | 1000 |
| 58 to 60 db SPL | 10771.9828 + −168.1034*XY |
| 60 to 62 db SPL | 6478.8793 + −96.5517*XY |
| 62 to 65 db SPL | 3263.0747 + −44.6839*XY |
| 65 to 65 db SPL | 1824.8563 + −22.5575*XY |

Figure 10:
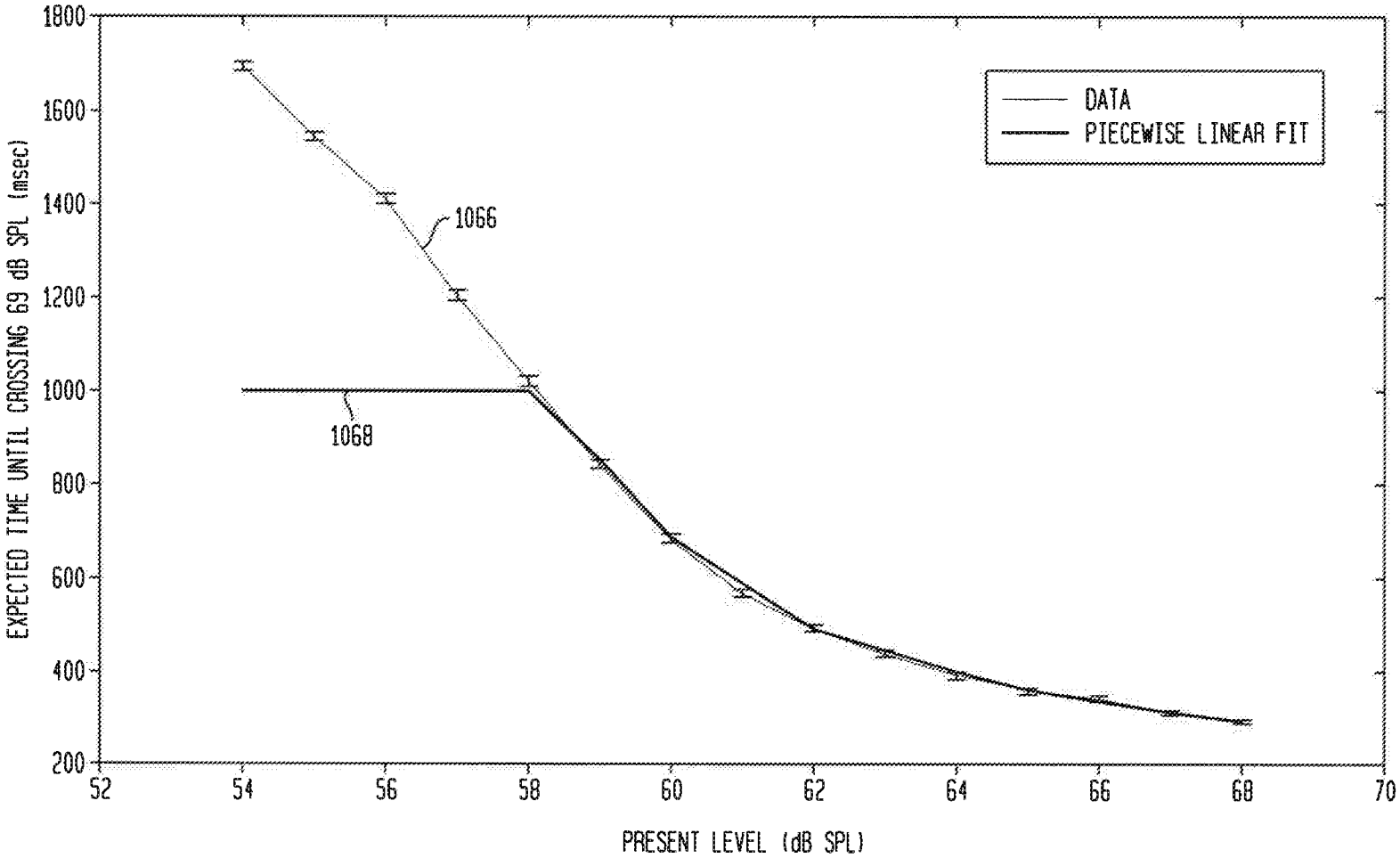
FIG. 10 is a graph illustrating an expected duration until crossing an example Fast AGC kneepoint for various sound levels, in accordance with embodiments presented herein.

FIG. 10 is a graph which includes a trace 1066 representing example expected durations until crossing a Fast AGC kneepoint (e.g., Y dB SPL) for various sound levels. FIG. 10 also includes a trace 1068 representing a piecewise linear fit to example data. As noted above, the expected value is longest for the softest sounds and is shortest for the loudest sounds. In FIG. 10, the initial AGC update period is 1 second, but may then be adjusted. The linear fit is truncated at 1000 ms, but this is only one implementation.

It is to be appreciated that Table 1 and FIG. 10 each illustrate example selected minimum expected values and that other values are possible. For example, different weighting functions could be used to skew the distribution to be more conservative or less conservative. However, in general, Table 1 and FIG. 10 illustrate that the new AGC update rate may be based on an analysis of the sound signal levels and, more particularly, based on a probabilistic determination of a minimum time period when the sound levels could cross the Fast AGC kneepoint. In certain arrangements, evidence of increasing sound levels may be utilized as part of the prediction of the time until the fast AGC threshold would be crossed.

Table 2, below, illustrates the results of an example decision algorithm for setting a new AGC update rate. In Table 2, the first row illustrates time, increasing from time 0 ms to 1500 ms and the second row illustrates the current AGC update rate. The third and fourth rows of Table 2 illustrate the left-side and right-side sound levels, respectively, (i.e., the levels of the sounds detected at each of the left and right prostheses 102L and 102R). The fifth and sixth rows of Table 2 illustrate the sound levels as transmitted from the left to the right and from the right to the left, respectively, (i.e., the levels of the sounds transmitted in AGC updates). Finally, the seventh and eighth rows of Table 2 illustrate the present sound levels as determined at the left and right prostheses, respectively, (i.e., the levels of the present sounds determined on both the sound level at the respective side and the sound level received from the contralateral side).

TABLE 2

| Time -> | Start (0 ms) | 1 ms | ... | 999 ms | 1000 ms (First TX/RX and first decision | ... | 1500 ms (Second TX/RX and second decision | ... |
|---|---|---|---|---|---|---|---|---|
| AGC Update Rate (ms) | 1000 | 1000 | ... | 1000 | 500 | ... | 500 | ... |
| Left-Side Signal Level (dB) | 55 | 55 | ... | 57 | 53 | ... | 60 | ... |
| Right-Side Signal Level (dB) | 55 | 56 | ... | 54 | 56 | ... | 62 | ... |
| Left to Right Level (dB) | NA | NA | ... | NA | 56 | ... | 60 | ... |
| Right to Left Level (dB) | NA | NA | ... | NA | 56 | ... | 62 | ... |
| Present to Level-Left (dB) | 54 | 55 | ... | 57 | 56 | ... | 62 | ... |
| Present to Level-Right (dB) | 55 | 56 | ... | 54 | 56 | ... | 62 | ... |

As shown in Table 1, the initial AGC update rate is 1000 ms, thus no AGC updates are sent until reaching the first 1000 ms mark. Since no AGC updates are sent until reaching the 1000 ms mark, the left to right and the right to left levels are not applicable (NA) (i.e., no AGC data is sent). As a result, the determination of the present levels at each of the right and left prostheses is based only on the sound level detected at the corresponding prosthesis.

Starting at the first 1000 ms mark, the left and right prostheses each transmit an AGC update indicating the current sound level detected thereby. Also at the 1000 ms mark, the left and right prostheses also determine the present sound signal level (i.e., 56 dB) using both the left and right side sound levels. Given the present sound signal level, the left and right prostheses also each determine a new AGC update rate of 500 ms. As a result, the next AGC update is sent at the 1500 ms mark where the left and right prostheses each update the present sound level and re-evaluate the AGC update rate. In this example, at the 1500 ms mark, both prostheses 102L and 102R leave the AGC update rate changed. Table 2 illustrates only the first 1500 ms of an example process that, in practice, could continue indefinitely during operation of the system 100. During this process, the prostheses 102L and 102R evaluate and, possibly dynamically adjust, the AGC update based on the detected sound levels.

The above description illustrates several example techniques for using the levels of received/detected (i.e., input) sound signals detected at each of the prostheses 102L and 102R to dynamically adjust the AGC update rate. In certain embodiments, the levels of the sound signals detected at each of the prostheses 102L and 102R may be analyzed to determine the ILD for the sound signals and the ILD is used to control selection of the AGC update rate (i.e., rate adjustment mechanism incorporates Interaural Level Difference Information). In certain examples, if a number of different sound targets are detected, the ILD may be determined based on the "worst" target (e.g., the target with the largest ILD).

Figure 11A:
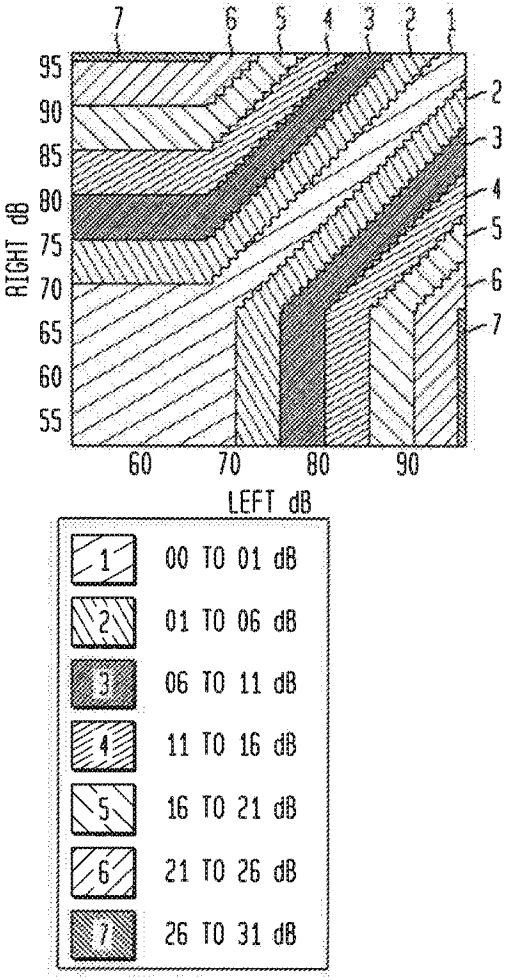
FIGS. 11A, 11B, and 11C are a series of diagrams schematically illustrating possible Interaural Level Difference (ILD) and unilateral errors that can occur as a result of AGC operations.
Figure 11B:
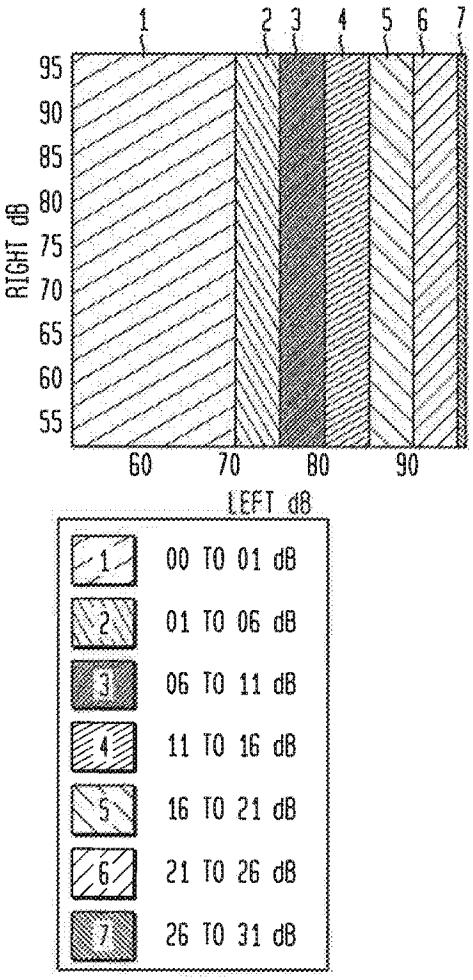
Figure 11C:
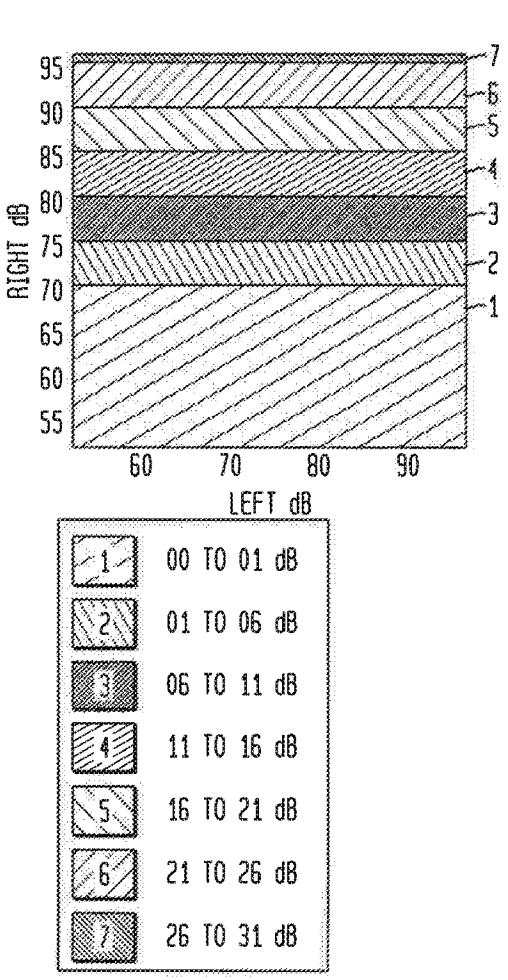

Additionally, extremely large ILDs will indicate that a recipient is experiencing a specific sound environment, such as either talking on the phone or in another environment in which the two ears should be handled separately. FIGS. 11A, 11B, and 11C are diagrams schematically illustrating ILD, left-side, and right-side errors, respectively, for levels in a succeeding update period. The magnitude of the left-side and right-side errors modulates the effects of the ILD errors.

Figure 12:
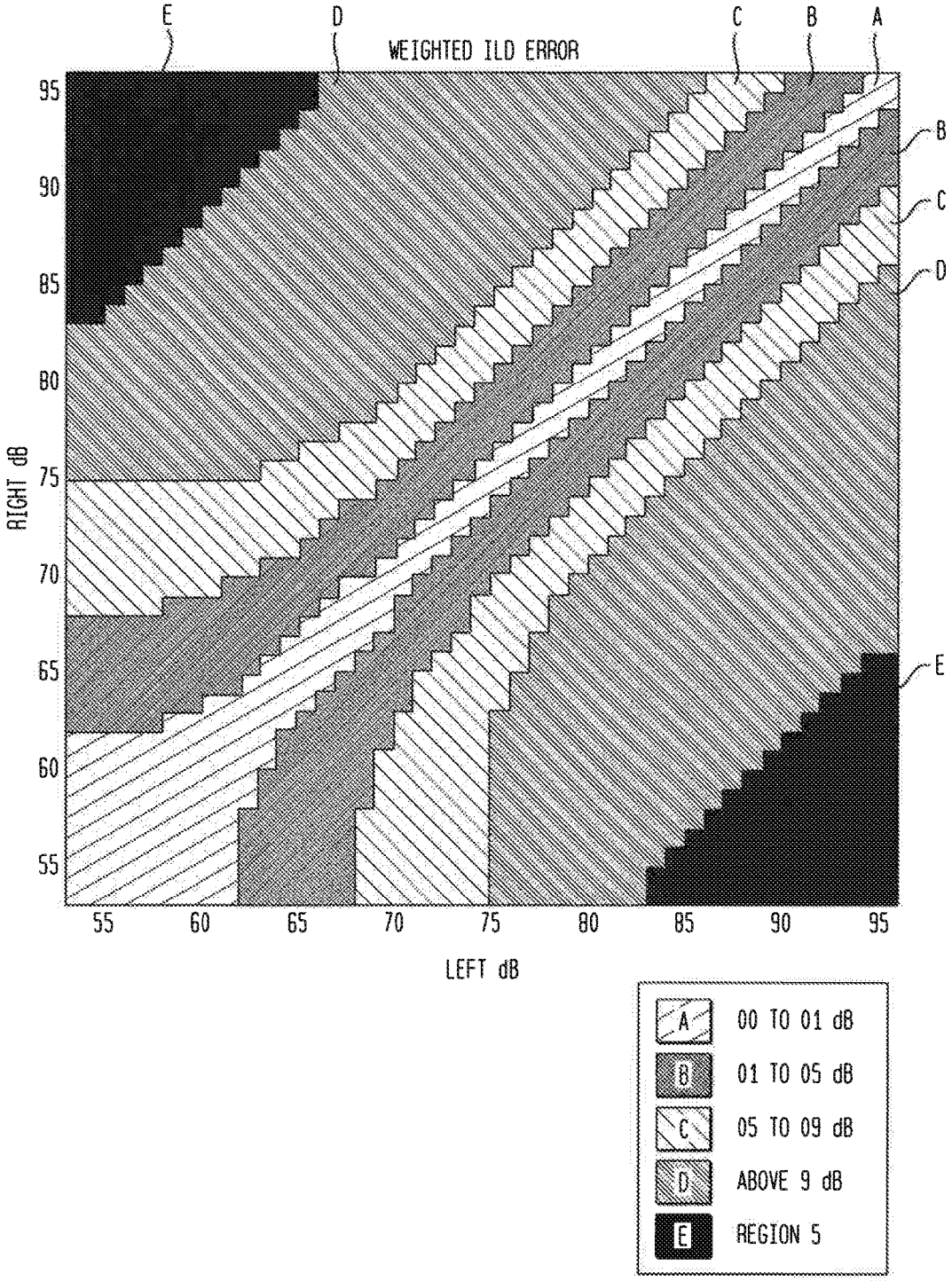
FIG. 12 is a diagram graphically illustrating ILD error results.

FIG. 12 is a diagram that schematically illustrates weighted ILD errors for levels in a present AGC update period. The left-side and right-side errors modulate the effects of the ILD errors. FIG. 12 also includes an additional "Region 5" (labeled by reference "E") for ILDs that are beyond those expected from single sources providing synchronous signals to the two ears.

Figure 13:
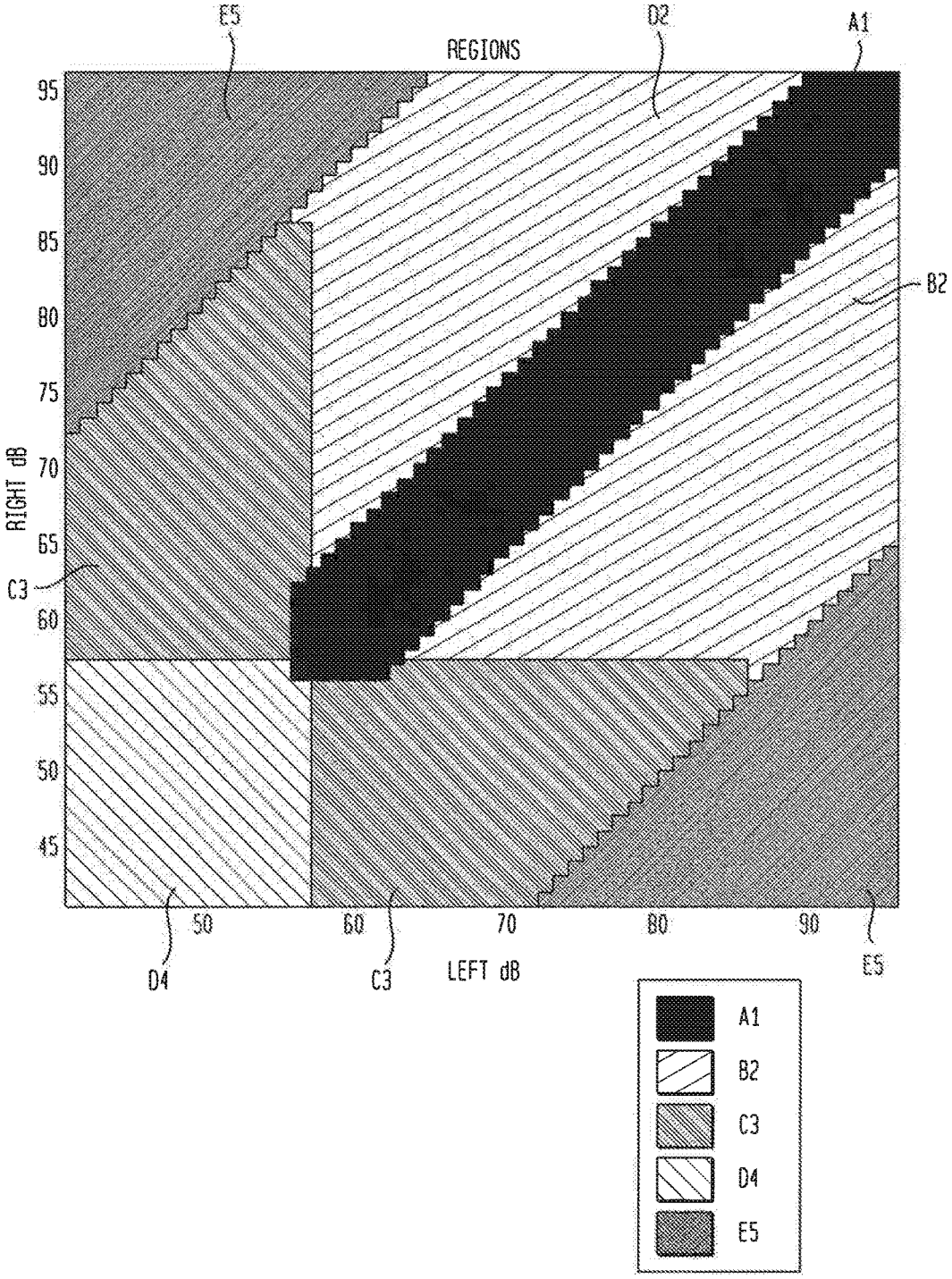
FIG. 13 is a diagram that schematically illustrates an example decision space to address ILD errors.
Figure 14:
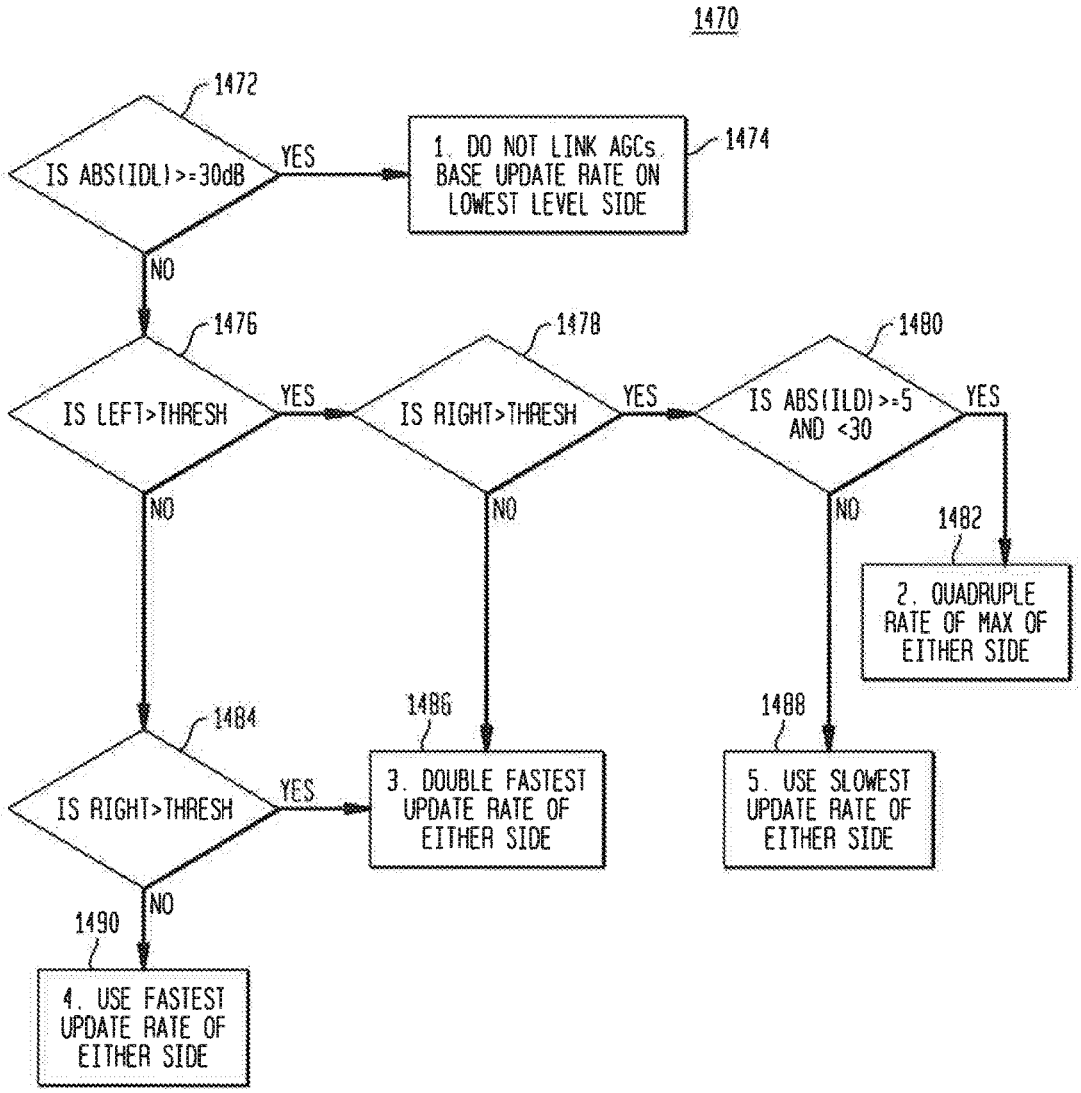
FIG. 14 is a flowchart of operations performed to identify and address ILD errors, in accordance with embodiments presented herein.

In summary, FIGS. 11A, 11B, and 11C illustrate the three different types of errors (left-side, right-side, and ILD) separately, while FIG. 12 illustrates a combined error designed to allow the algorithm to set the update rate to minimize the error. FIG. 13 shows the decision space graphically, while FIG. 14 is a flowchart of the decision process that makes use of ILDs to set the AGC update rate. In FIGS. 13 and 14, to handle the various errors, different actions are taken in each region for the levels of the left and right in the current AGC update period. A further description of the method 1470 of FIG. 14 is provided below.

Referring first to FIG. 13, region A1 represents a region in which the sound signal levels at both bilateral prostheses are predicted to be above above the Fast AGC kneepoints in the following period (bin), but with small expected ILDs. The B2 regions represent regions in which the sound signal levels at both bilateral prostheses are predicted to be above above the Fast AGC kneepoints in the following period, with moderate ILD values. Regions C3 represent parts of the decision space in which the sound signal level at one prosthesis is predicted to be above the Fast AGC kneepoint in the next period and there is an ILD ranging up to 30 dB. Region D4 represents a part of the decision space in which sound signal levels at both bilateral prostheses are predicted to be below the FAST AGC kneepoint in the next period. Regions E5 represents parts of the decision space in which the ILD is sufficiently large as to be consistent with the sounds at the two ears being from different/uncorrelated sources.

FIG. 14 illustrates that the method 1470 can have five (5) different results, shown at 1474, 1482, 1486, 1490, and 1488. The following description of FIG. 14 will focus on how the bilateral system 100 reaches each of these five results. It is to be appreciated that the results at 1474, 1482, 1486, 1490, and 1488 are merely example results and that other results are possible in different implementations.

Referring first to result 1474, the method begins at 1471 were the ILD between the left and right prostheses 102L and 102R is determined and compared to an absolute difference threshold which, in this example, is 30 dB. In this case, the ILD is greater than or equal to the absolute difference threshold and the method 1470 proceeds to 1474 where the operations of the two AGC systems are de-linked. In this case, the AGC update rate is selected based on the lowest sound level detected at either the left or right prostheses because the left and right prostheses 102L and 102R are likely detecting different sources.

Referring next to result 1482, the ILD between the left and right prostheses 102L and 102R is determined and compared to an absolute difference threshold at 1472. In this case, the ILD is less than the absolute difference threshold and the method 1470 proceeds to 1476 where the left-side sound level is compared to a predetermined threshold. In certain embodiments, the predetermined threshold is a sound level that is above the kneepoint of the Slow AGC, but well below the kneepoint of the Fast AGC.

Continuing with description of result 1482, the left-side sound level is determined to be greater than or equal to the predetermined threshold and, as such, the method proceeds to 1478. At 1478, the right-side sound level is compared to the predetermined threshold and it is determined that the right-side sound level is greater than or equal to the predetermined threshold, thus method 1470 proceeds to 1480. At 1480, a determination is made as to whether the ILD between the left and right prostheses 102L and 102R is below the absolute difference threshold, but above a minimum threshold. It is determined that the ILD between the left and right prostheses 102L and 102R is below the absolute difference threshold, but above the minimum threshold. As such, the method 1470 reaches result 1482 where the left and right prostheses 102L and 102R significantly increase (e.g., quadruple) the AGC update rate. Result 1482 indicates the possibility of the most problematic errors from FIGS. 11A-13 and, as such, the AGC update rate is increased in an attempt to minimize the impact of these errors.

Results 1486, 1490, and 1488 each begin with a determination at 1472 that the ILD between the left and right prostheses 102L and 102R is below absolute difference threshold. As such, results 1486, 1490, and 1488 are each described beginning at 1476.

In particular, referring first to result 1486, it is determined at 1476 that the left-side sound level is greater than or equal to the predetermined threshold and, as such, the method proceeds to 1478. At 1478, the right-side sound level is compared to the predetermined threshold and it is determined that the right-side sound level is less than the predetermined threshold. As such, method 1470 proceeds to result 1486 where the left and right prostheses 102L and 102R increase (e.g., double) the AGC update rate. Result 1486 indicates the possibility of that one of the sound levels at one of the prostheses is likely to cross the predetermined threshold and, accordingly, introduce errors. However, the errors introduced in this case are not as significant as those in result 1482, thus the rate does not have to be increased as much (i.e., these errors are more tolerable and do not have to be as carefully avoided).

Referring next to result 1490, it is determined at 1476 that the left-side sound level is less than the predetermined threshold and, as such, the method proceeds to 1484. At 1484, the right-side sound level is compared to the predetermined threshold. A determination at 1484 that the right-side sound level is greater than or equal to the predetermined threshold again leads to result 1486. However, a determination at 1484 that the right-side sound level is less than the predetermined threshold leads to result 1490. At 1490, the fastest rate for either prosthesis 102L or 102R is used for the AGC updates. Result 1490 indicates the neither the left-side nor the right-side sound levels are expected to cross the predetermined threshold.

Referring lastly to result 1488, it is determined at 1476 that the left-side sound level is greater than or equal to the predetermined threshold and, as such, the method proceeds to 1478. At 1478, the right-side sound level is compared to the predetermined threshold and it is determined that the right-side sound level is also greater than or equal to the predetermined threshold. As such, method 1470 proceeds to 1480 where a determination is made as to whether the ILD between the left and right prostheses 102L and 102R is below the absolute difference threshold, but above a minimum threshold. It is determined that the ILD between the left and right prostheses 102L and 102R is below the absolute difference threshold, but also below the minimum threshold. As such, the method 1470 reaches result 1488 where the slowest rate for either prosthesis 102L or 102R is used for the AGC updates. Result 1488 indicates errors that are least likely to be detectable by the recipient. As noted above, the results shown in FIG. 14 (i.e., results 1474, 1482, 1486, 1488, and 1490) are merely example embodiments.

Alternatively or in addition to the above, certain embodiments presented herein may make use of the present state of one or more of the AGC systems (i.e., signals within the AGCs themselves) to determine the AGC update rate. That is, these embodiments use the effective levels internal to the AGC systems, which combine the external level (i.e., absolute levels in the environment) with the some or all aspects of the currently applied AGC gain (i.e., internal state of the AGC), to set the update rates. For example, if the sound signals have a level (input level) of Y dB, and the presently applied Slow AGC gain is −10 dB, then the effective level is lower than the sound signal level. As such, the AGC update rate can be slower than if the present Slow AGC gain is 0 dB with the same input level, because the AGC systems are not close to having a negative effect on the signal. This can be contrasted to a situation where the input is the same as above, Y dB SPL, but there is no negative gain applied and the system is much closer to hitting the Fast AGC kneepoint.

Figures 15A, 15B, 15C, 15D, 15E:
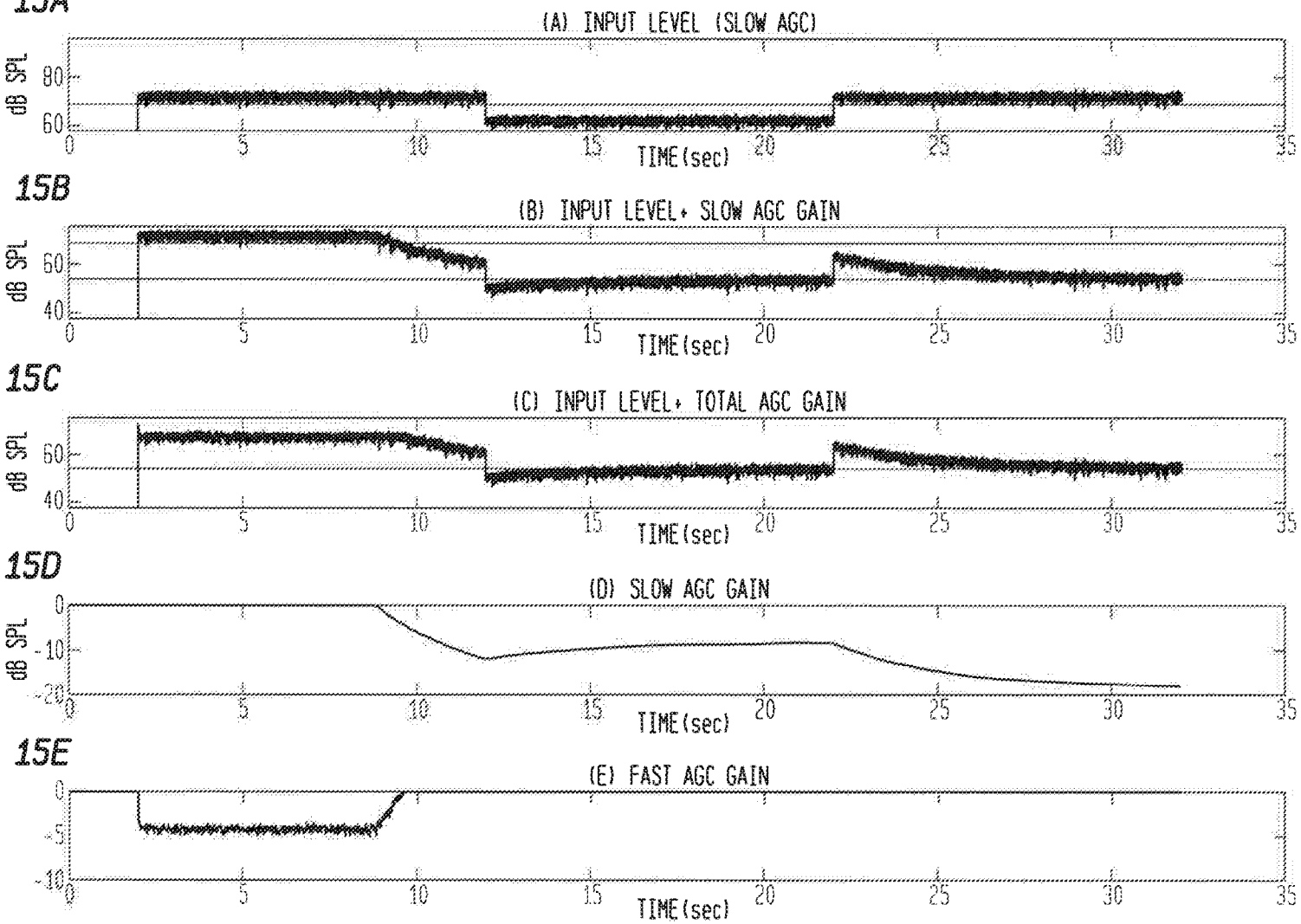
FIGS. 15A-15E are a series of diagrams illustrating the effects of considering the internal AGC state to dynamically adjust an AGC update rate, in accordance with embodiments presented herein.

FIGS. 15A-15E are a series of diagrams illustrating the effects of considering the internal AGC state for the AGC update rate. In general, FIGS. 15A-15E show that the effective level of a signal after application of the Slow AGC, rather than the input sound level, is the key determinant of the response of the Fast AGC. FIG. 15A shows an input signal at 74 dB SPL for 10 seconds, followed by a level of 64 dB SPL for 10 seconds, which is again followed by an input signal at 74 dB SPL for 10 seconds. FIG. 15B shows the effective levels for the signals of FIG. 15A after application of the Slow AGC. As shown in FIG. 15B, the waveform between approximately 22-32 seconds is quite different than the one between approximately 2-12 seconds. Therefore, even though the input is the same at 2 and 22 seconds, the effective level is quite different.

FIG. 15C shows the total effect of the AGC system on the input signal. Once again times 2 and 22 are quite different. FIG. 15D shows the time course of the Slow AGC, while FIG. 15E shows the time course of the Fast AGC. As shown, the time course of the Fast AGC is non-zero between 2 and 10 seconds, but it is zero between 22 and 32 seconds because the Slow AGC reduced the effective level below the response level (i.e., kneepoint) for the Fast AGC.

As noted above, in certain embodiments the selection of the AGC update rate is a probabilistic determination based on when the input sound signal levels will cross the Fast AGC kneepoint. In further embodiments, the AGC update rate the selection of the AGC update rate is a probabilistic determination based on when either the effective left-side or the right-side sound levels (i.e., the post-Slow AGC levels) will cross the Fast AGC kneepoint. In one form, for post-slow AGC signals, the expected time until crossing a threshold estimated is determined to be approximately 140 ms longer when compared to embodiments that make use of the input sound levels (i.e., pre-slow AGC signals) illustrated above in Table 1. As such, the equation result is increased by 140 ms, leading to the results shown below in Table 3.

TABLE 3

| Effective (post-Slow AGC) Sound Level | Minimum Expected Value (i.e., expected minimum time to cross Fast AGC kneepoint) |
|---|---|
| Less than 58 db SPL | 1000 |
| 58 to 60 db SPL | 10911.9828 + −168.1034*X |
| 60 to 62 db SPL | 6618.8793 + −96.5517*X |
| 62 to 65 db SPL | 3403.0747 + −44.6839*X |
| 65 to 65 db SPL | 4.8563 + −22.5575*X |

Bilateral hearing prostheses may each include an environment or sound classifier that is configured to perform environmental classification operations. That is, the sound classifier is configured to use received sound signals to "classify" the ambient sound environment and/or the sound signals into one or more sound categories (e.g., determine the type" of the received sound signals). The categories may include, but are not limited to, "Speech," "Noise," "Speech in Noise," "Quiet," "Music," or "Wind."

In certain embodiments presented herein, the bilateral hearing prostheses are configured to use the output of the sound classifier and/or other aspects of the environment to dynamically adjust the AGC update rate. For example, in a "Quiet" environment (e.g., sound signal levels below X dB SPL), the AGC update link could be disabled to conserve power. In "Music," "Speech," "Speech in Noise," or other environments, the AGC update link could be enabled when the sound signal levels at either prosthesis rises above some threshold (e.g., X dB SPL). The different environments could also use different default AGC update rates (e.g., "Speech in Noise would have a different (higher) default AGC rate than just "Speech"). In the case of a "Wind" environment, the presence of the wind could add improper binaural cues and, as such, the AGC update link could be disabled. Table 4, below, illustrates example combinations of sound classifier state/result, effective sound levels, and the resulting AGC update rate.

TABLE 4

| Classifier State | Effective Level (dB SPL peak) | AGC Update Rate |
|---|---|---|
| Quiet, Music, Speech, Noise | <X | Default Rate |
| Quiet, Music, Speech, Noise | X to Y | Default Rate |
| Quiet, Music, Speech, Noise | >Y | Default Rate |
| Speech in Noise | <X | Default Rate |
| Speech in Noise | X to Y | Double the Default Rate |
| Speech in Noise | >Y | Default Rate |
| Wind | <X | Do Not Link Bilateral AGC Systems |
| Wind | X to Y | Do Not Link Bilateral AGC Systems |
| Wind | >Y | Do Not Link Bilateral AGC Systems |

Embodiments of the present invention may use other information to dynamically adjust the AGC update rate. For example, the bilateral prostheses could modify the AGC update rate based on non-sound signals received from the ambient environment (e.g., a beacon) to detect specific listening situations (e.g., the recipient is in a car). The identification of specific environments can result in an increase in the AGC update rate.

In further embodiments, the bilateral prostheses include controls that enable the recipient or other user to control the AGC update rate. For example, the bilateral prostheses could be placed into different operational modes, such as a "power saving mode" which would reduce the AGC update rate, a "lecture," "sports," or type of mode that would increase the AGC rate when the recipient wants to receive maximal information. These specific modes are merely illustrative.

It is to be appreciated certain bilateral systems may use asynchronous transmission. In these embodiments, the bilateral prostheses may adjust the AGC gain when the ipsilateral AGC gain is less than the received contralateral gain.

In addition, upon receiving a new AGC value from the other prosthesis, instead of changing the ipsilateral AGC gain instantly, the AGC value instantly, the gain may be changed gradually as a function of the current AGC update period so not to introduce perceptual artifacts.

Figure 16:
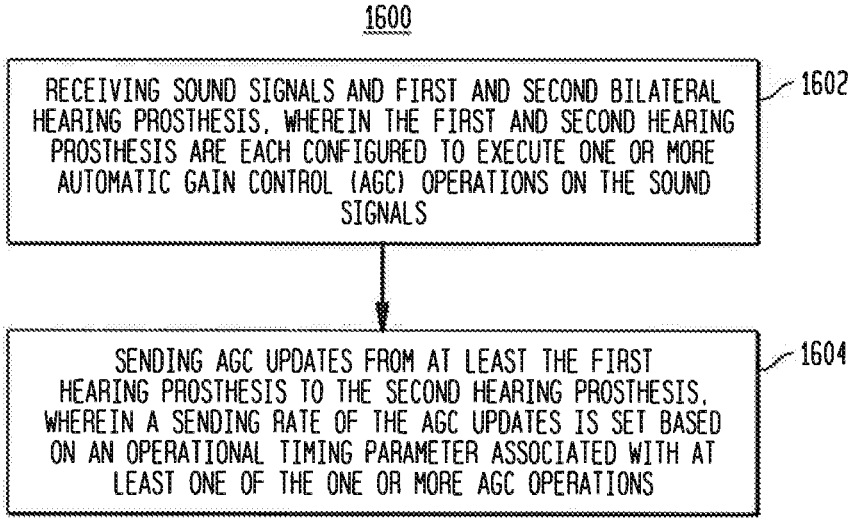
FIG. 16 is a high-level flowchart of a method, in accordance with embodiments presented herein.

FIG. 16 is a flowchart of a method 1600 in accordance with embodiments presented herein. Method 1600 begins at 1602 where sound signals are received at first and second bilateral hearing prostheses. The first and second hearing prostheses are each configured to execute one or more automatic gain control (AGC) operations on the sound signals. At 1604, at least the first hearing prosthesis sends (e.g., wirelessly or via a wired connection) AGC updates to the second hearing prosthesis. The sending rate of the AGC updates is set based on an operational timing parameter associated with at least one of the one or more AGC operations.

In conventional arrangements, two independent automatic gain control (AGC) systems in bimodal or bilateral situation will distort binaural cues. Therefore, as noted above, localization and speech understanding can be improved in a bilateral hearing prosthesis system by linking of the AGC information between the two bilateral prostheses. Presented herein are techniques to perform this AGC linking in an energy efficient manner, while still providing these benefits. In particular, the embodiments presented herein may use a predetermined AGC update rate that is selected to provide power savings while preserving binaural cues. This predetermined AGC update rate may be dynamically adjusted in a number of different manners based on a variety of different types of information. For example, certain embodiments operate to adjust the rate to avoid the triggering of the Fast AGC when possible, while other embodiments operate to adjust the update rate based on the statistics of real sounds and their interaction with the AGC rather than an arbitrary rule thus providing the best outcome for given power constraint. Still other embodiments can use the internal state of the AGC systems to determine the update rate, while other embodiments based the AGC update rate on the levels on both sides and the difference between those levels.

It is to be appreciated that the above embodiments are not mutually exclusive and may be combined with one another in various arrangements.

The invention described and claimed herein is not to be limited in scope by the specific preferred embodiments herein disclosed, since these embodiments are intended as illustrations, and not limitations, of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A bilateral hearing prosthesis system, comprising:

a first hearing prosthesis including:

at least a first sound input element configured to receive sound signals, and a first automatic gain control (AGC) system configured to attenuate levels of the sound signals received at the at least first sound input element in accordance with one or more time constants; and a second hearing prosthesis including:

at least a second sound input element configured to receive sound signals, and a second AGC system configured to attenuate levels of the sound signals received at the at least second sound input element in accordance with one or more time constants, wherein the first and second hearing prostheses are configured to exchange AGC updates with one another at an AGC update rate selected based on at least one of the one or more time constants of the first AGC system or at least one of the one or more time constants of the second AGC system.

2. The bilateral hearing prosthesis system of claim 1, wherein the first and second AGC systems each comprise a plurality of AGC blocks, wherein the plurality of AGC blocks each have different associated kneepoints and time constants, and wherein the AGC update rate is a function of a time constant associated with one of the plurality of AGC blocks of the first or second AGC systems.

3. The bilateral hearing prosthesis system of claim 2, wherein the AGC update rate is a function of a slowest time constant associated with one of the plurality of AGC blocks of the first or second AGC systems.

4. The bilateral hearing prosthesis system of claim 1, wherein the first and second hearing prostheses are configured to dynamically adjust the AGC update rate.

5. The bilateral hearing prosthesis system of claim 4, wherein the first and second hearing prostheses are configured to dynamically adjust the AGC update rate based on a probabilistic determination of when a level of the sound signals received at one or more of the at least first sound input element or the at least second sound input element is likely to cross a predetermined threshold level.

6. The bilateral hearing prosthesis system of claim 5, wherein the first and second AGC systems each comprise a plurality of AGC blocks, wherein the plurality of AGC blocks each have different associated kneepoints and time constants, and wherein the predetermined threshold level is a kneepoint associated with one of the plurality of AGC blocks having a fastest associated time constant.

7. The bilateral hearing prosthesis system of claim 4, wherein the first and second hearing prostheses are configured to dynamically adjust the AGC update rate based on an effective signal level of the sound signals after application of a gain by one or more of the first or second AGC systems.

8. The bilateral hearing prosthesis system of claim 4, wherein the first and second hearing prostheses are configured to dynamically adjust the AGC update rate based on an Interaural Level Difference (ILD) determined for the sound signals received at the at least first sound input element and the at least second sound input element.

9. The bilateral hearing prosthesis system of claim 4, wherein the first and second hearing prostheses are configured to dynamically adjust the AGC update rate based on a classification of a sound environment by at least one of the first or second hearing prostheses.

10. The bilateral hearing prosthesis system of claim 1, wherein the AGC updates sent by the first and second hearing prostheses identify the level of the sound signals detected at the at least first sound input element and the at least second sound input element, respectively.

11. A method, comprising:

receiving sound signals at first and second bilateral hearing prostheses, wherein the first and second hearing prostheses are each configured to execute one or more automatic gain control (AGC) operations to attenuate the sound signals in accordance with one or more time constants; and sending AGC updates from at least the first hearing prosthesis to the second hearing prosthesis, wherein a sending rate of the AGC updates is set based on at least one of the one or more time constants used for attenuation of the sound signals during the one or more AGC operations of the first or second hearing prosthesis.

12. The method of claim 11, wherein the one or more AGC operations at each of the first and second hearing prostheses comprise a plurality of different AGC stages, wherein the plurality of AGC stages each have different associated kneepoints and time constants, the method further comprising:

setting the sending rate of the AGC updates based on a slowest time constant associated with one of the plurality of AGC stages at one or more of the first or second hearing prostheses.

13. The method of claim 11, further comprising:

dynamically adjusting the sending rate of the AGC updates.

14. The method of claim 13, further comprising:

dynamically adjusting the sending rate of the AGC updates based on a probabilistic determination of when a level of the sound signals received at one or more of the first or second hearing prostheses is likely to cross a predetermined threshold level.

15. The method of claim 14, wherein the one or more AGC operations at each of the first and second hearing prostheses comprise a plurality of different AGC stages, wherein the plurality of AGC stages each have different associated kneepoints and time constants, and wherein the predetermined threshold level is a kneepoint associated with one of the plurality of AGC stages having a fastest associated time constant.

16. The method of claim 13, further comprising:

dynamically adjusting the sending rate of the AGC updates based on an effective signal level of the sound signals after application of a gain by one or more of the AGC operations at one or more of the first and second hearing prostheses.

17. The method of claim 13, further comprising:

dynamically adjusting the sending rate of the AGC updates based on an Interaural Level Difference (ILD) determined for the sound signals received at the first and second hearing prostheses.

18. The method of claim 13, further comprising:

dynamically adjusting the sending rate of the AGC updates based on a classification of a sound environment by at least one of the first or second hearing prostheses.

19. The method of claim 11, wherein the AGC updates sent by the first hearing prosthesis identify the level of the sound signals detected at the first hearing prosthesis.

20. A hearing prosthesis, comprising:

an automatic gain control (AGC) system configured to manipulate levels of sound signals received at the hearing prosthesis in accordance with one or more time constants; and a transceiver configured to operate a wireless AGC channel over which AGC updates can be sent to a second hearing prosthesis, and wherein the rate at which AGC updates are sent by the transceiver is based on at least one of the one or more time constants used by the AGC system.

21. The hearing prosthesis of claim 20, wherein the AGC updates sent by the first hearing prosthesis include information identifying the level of the sound signals detected at the first hearing prosthesis.

22. The hearing prosthesis of claim 20, wherein the rate at which AGC updates are sent by the transceiver is dynamically adjustable based on a probabilistic determination of when a level of the sound signals received at one or more of the first or second hearing prostheses is likely to cross a predetermined threshold level.

23. The hearing prosthesis of claim 20, wherein the rate at which AGC updates are sent by the transceiver is dynamically adjustable based on an Interaural Level Difference (ILD) determined for sound signals received at the first and second hearing prostheses.

24. The hearing prosthesis of claim 20, wherein the rate at which AGC updates are sent by the transceiver is dynamically adjustable based on a classification of a sound environment by at least one of the first or second hearing prostheses.

25. The hearing prosthesis of claim 20, wherein the AGC system comprises a plurality of AGC blocks, wherein the plurality of AGC blocks each have different associated kneepoints and time constants, and wherein the rate at which AGC updates are sent by the transceiver is a function of a time constant associated with at least one of the plurality of AGC blocks.

26. The hearing prosthesis of claim 25, wherein the rate at which AGC updates are sent by the transceiver is a function of a slowest time constant associated with one of the plurality of AGC blocks.

27. The hearing prosthesis of claim 25, wherein the rate at which AGC updates are sent by the transceiver is dynamically adjustable based on an effective signal level of the sound signals after application of a gain by one or more of the plurality of AGC blocks.

* * * * *